US011505948B2

(12) United States Patent
Crenshaw

(10) Patent No.: US 11,505,948 B2
(45) Date of Patent: Nov. 22, 2022

(54) WALL SYSTEM

(71) Applicant: MfPHD, LLC, Lorena, TX (US)

(72) Inventor: Thomas Crenshaw, Lorena, TX (US)

(73) Assignee: mfPHD, LLC, Lorena, TX (US)

( * ) Notice: Subject to any disclaimer, the term of this patent is extended or adjusted under 35 U.S.C. 154(b) by 111 days.

(21) Appl. No.: 17/098,364

(22) Filed: Nov. 14, 2020

(65) Prior Publication Data

US 2021/0396020 A1 Dec. 23, 2021

(51) Int. Cl.

| | |
|---|---|
| ***E04F 13/12*** | (2006.01) |
| ***E04C 2/08*** | (2006.01) |
| ***E04F 13/08*** | (2006.01) |
| ***E04B 1/94*** | (2006.01) |

(52) U.S. Cl.

CPC ..... *E04F 13/12* (2013.01); *E04B 1/94* (2013.01); *E04C 2/08* (2013.01); *E04F 13/0898* (2013.01)

(58) Field of Classification Search

CPC ..... E04F 13/12; E04F 13/0898; E04B 2002/7498; E04B 1/94; E04C 2/08; B32B 2607/00

See application file for complete search history.

(56) References Cited

U.S. PATENT DOCUMENTS

| | | | | |
|---|---|---|---|---|
| 1,918,228 A | | 7/1933 | Spencer | |
| 2,851,134 A | | 9/1958 | Robinson, Jr. | |
| 3,906,696 A | | 9/1975 | Poter et al. | |
| 3,989,397 A | ‡ | 11/1976 | Baker | F16B 12/02 403/205 |
| 4,122,203 A | * | 10/1978 | Stahl | E04B 1/94 264/46.7 |
| 4,477,201 A | ‡ | 10/1984 | Yoshiyuji | F16B 12/02 403/205 |
| 5,297,370 A | | 3/1994 | Greenstreet et al. | |
| 5,592,786 A | * | 1/1997 | Kamm | E04F 19/026 362/147 |
| 5,816,003 A | ‡ | 10/1998 | Larsson | F16B 7/0473 52/281 |

(Continued)

FOREIGN PATENT DOCUMENTS

| | | | |
|---|---|---|---|
| CN | 102383507 A | ‡ | 3/2012 |
| CN | 102383507 A | | 3/2012 |

(Continued)

OTHER PUBLICATIONS

Song, Jin-Hee et al., "Evaluation of alternatives for reducing thermal bridges in metal panel curtain wall systems", Elsevier, Energy and Buildings 127, 2016, pp. 138-158, https://www.researchgate.net/publication/303534203_Evaluation_of_Alternatives_for_Reducing_Thermal_Bridges_in_Metal_Panel_Curtain_Wall_Systems, Last accessed Apr. 9, 2021.‡

(Continued)

*Primary Examiner* — Andrew J Triggs

(74) *Attorney, Agent, or Firm* — Patterson + Sheridan, LLP

(57) ABSTRACT

A monolithic corner and/or adapter panel encapsulates one or more panels while maintaining structural integrity and maintain hygienic properties. The corner may securely receive one or more panels and provide flexibility to easily adjust the one or more panels. The corner and/or adapter panel may simplify installation and an ability to adjust connected panels without compromising safety, installation time, and sterility.

22 Claims, 29 Drawing Sheets

(56) References Cited

U.S. PATENT DOCUMENTS

| | | | | |
|---|---|---|---|---|
| 6,070,377 | A ‡ | 6/2000 | Guevara Guzman | E04B 2/7401 52/238.1 |
| 6,792,727 | B2 ‡ | 9/2004 | Krieger | E04C 2/328 52/235 |
| 7,303,358 | B1 ‡ | 12/2007 | Fuller | E02B 7/22 256/31 |
| 7,805,899 | B2 ‡ | 10/2010 | Montgomery | E04F 13/18 52/235 |
| 8,033,066 | B2 ‡ | 10/2011 | Griffiths | E04F 13/081 52/235 |
| 8,063,116 | B2 * | 11/2011 | Trogolo | C09D 5/033 428/407 |
| 8,245,467 | B2 ‡ | 8/2012 | Lewis | B64D 11/00 52/282.3 |
| 8,484,931 | B2 ‡ | 7/2013 | Gleeson | E04F 19/062 52/747.1 |
| 8,596,000 | B2 ‡ | 12/2013 | Mitchell | E04C 2/38 52/288.1 |
| 9,003,737 | B2 ‡ | 4/2015 | Solomon | E04B 2/7453 52/656.9 |
| 9,010,068 | B2 | 4/2015 | Sullivan et al. | |
| 9,169,641 | B2 ‡ | 10/2015 | Wickstrom | E04F 13/0851 |
| 9,499,978 | B2 | 11/2016 | Glancy | |
| 9,523,205 | B2 | 12/2016 | Vigouroux et al. | |
| D784,560 | S ‡ | 4/2017 | D'Anglade | D25/119 |
| 9,635,941 | B2 ‡ | 5/2017 | Bates | E03C 1/181 |
| 9,874,026 | B2 | 1/2018 | Bilge | |
| 10,011,997 | B1 | 7/2018 | Bilge | |
| 10,072,411 | B1 ‡ | 9/2018 | Moran | E04H 1/1272 |
| 10,267,045 | B1 ‡ | 4/2019 | Knight, Jr. | E04F 13/12 |
| 10,316,525 | B1 | 6/2019 | Bilge | |
| 10,858,167 | B2 | 12/2020 | D'Anglade | |
| 11,098,477 | B2 * | 8/2021 | Crenshaw | E04B 1/38 |
| 2004/0211127 | A1 ‡ | 10/2004 | Wiechecki | E04B 2/745 52/36.1 |
| 2006/0000176 | A1 ‡ | 1/2006 | Taylor | E04F 19/062 52/461 |
| 2007/0227089 | A1 ‡ | 10/2007 | Lewis | B64D 11/00 52/468 |
| 2010/0095624 | A1 ‡ | 4/2010 | Lewis | B64D 11/00 52/468 |
| 2012/0304568 | A1 ‡ | 12/2012 | Aboukhalil | E04F 19/062 52/309.1 |
| 2013/0326987 | A1 ‡ | 12/2013 | Krieger | E04F 13/0826 52/483.1 |
| 2014/0259970 | A1 ‡ | 9/2014 | Shapiro | E04B 1/7629 52/27 |
| 2015/0020468 | A1 | 1/2015 | Wickstrom | |
| 2016/0273217 | A1 ‡ | 9/2016 | Huntzinger | E04B 9/28 |
| 2018/0274231 | A1 ‡ | 9/2018 | Epstein | E04B 2/7442 |
| 2020/0149270 | A1 ‡ | 5/2020 | Crenshaw | E04B 1/38 |
| 2021/0372119 | A1 * | 12/2021 | Crenshaw | E04B 2/78 |
| 2021/0396020 | A1 * | 12/2021 | Crenshaw | E04B 1/94 |

FOREIGN PATENT DOCUMENTS

| | | | |
|---|---|---|---|
| CN | 110439204 | A ‡ | 11/2019 |
| CN | 110439204 | A | 11/2019 |
| CN | 111101673 | A ‡ | 5/2020 |
| CN | 111101673 | A | 5/2020 |
| DE | 2650886 | A1 | 5/1977 |
| KR | 20100021852 | A | 2/2010 |
| RU | 2494198 | C1 ‡ | 9/2013 |
| RU | 2494198 | C1 | 9/2013 |
| WO | 2012041331 | A1 | 4/2012 |
| WO | 2017201578 | A1 | 11/2017 |

OTHER PUBLICATIONS

Major, Maciej et al., "Effect of Steel Framing for Securing Drywall Panels on Thermal and Humidity Parameters of the Outer Walls", De Gruyter Open, vol. 13, Issue Feb. 2017, pp. 86-91, https://sciendo.com/article/10.1515/cee-2017-0011, Last accessed Apr. 9, 2021.‡

"Drywall Handbook", Gyproc Saint-Gobain, pp. 1-44, https://www.gyproc.in/pdf/Drywall-Handbook.pdf, Last accessed Apr. 9, 2021.‡

"Walling for healthcare", Altro, pp. 1-4, https://www.altro-me.com/Walls-and-doors/Sector/Healthcare, Last accessed Apr. 9, 2021.‡

"Modular Operation Theater", Creative Health Tech Pvt. Ltd., pp. 1-5, https://www.creativemodularot.co.in/modular-operationtheater.html, Last accessed Apr. 9, 2021.‡

Gypsum Board Assemblies, Erie Construction Council Inc, pp. 1-124, http://www.erieconstructioncouncil.com/plan_room_documents/Div%2009.pdf, Last accessed Apr. 9, 2021.‡

Crandall, Brianna, "Metl-Span white paper lists benefits of insulated metal panels", FMLink, Jan. 18, 2016, pp. 1-3, https://www.fmlink.com/articles/metl-span-white-paper-lists-benefits-of-insulated-metal-panels/, Last accessed Apr. 9, 2021.‡

Teal, Derrick, "Insulated metal wall and roof panels for sustainability and energy efficiency", Jul. 10, 2014, pp. 1-7, https://www.slideshare.net/DerrickTeal/insulated-metal-wall-and-roof-panels-for-sustainability-and-energy-efficiency-edc1, Last accessed Apr. 9, 2021.‡

"Insulated metal panels installation guide," Ceco Building Systems, pp. 1-84, https://www.cecobuildings.com/wp-content/uploads/2018/10/Insulated-Panels-Installation-Manual.pdf, Last accessed Apr. 9, 2021.‡

"Modular wall, door and ceiling system", Medifa, pp. 1-13, https://www.medifa.com/modular-room-systems/?lang=en, Last accessed Apr. 9, 2021.‡

"MEDglas™ Prefabricated OR Walls", Steris, pp. 1-7, https://www.steris.com/healthcare/products/or-environment/medglas-prefabricated-or-walls, Last accessed Apr. 9, 2021.‡

"EASE Modular Systems", Skytron, pp. 1-4, https://www.skytron.com/wp-content/uploads/documentation/Modular-Walls-Brochure-WEB.pdf, Last accessed Apr. 9, 2021.‡

"Modular Wall System", Axis medical construction, pp. 1-4, https://www.axismedical.gr/modular-wall-system/, Last accessed Apr. 9, 2021.‡

"WPS-12 Stainless Steel Wall Covering", ProTek Systems Inc, pp. 1-6, https://www.proteksystem.com/product/wps-12-stainless-steel-wall-system/, Last accesed Apr. 9, 2021.‡

"stainless steel modular walls", Vistamedikal, pp. 1-5, http://hospital-tech.com/solutions/stainless-steel-modular-walls/, Last accessed Apr. 9, 2021.‡

"Walls and ceiling panel system", Infimed, pp. 1-2, http://www.infimed.pl/en/walls-and-ceiling-panel-system,25.html, Last accessed Apr. 9, 2021.‡

"Modular Walls", Skytron, pp. 1-4, https://www.skytron.com/products/architectural/modular-walls/#, Last accessed Apr. 9, 2021.‡

"Modular Room System for Operating Theatres", Infimed, pp. 1-20, http://www.infimed.pl/zdjecia/a/zal/ot-rooms-en-2020-high_202101201158.pdf, Last accessed Apr. 9, 2021.‡

"Stainless Steel Walls", IntegroMed, p. 1, https://www.integromed.de/en/products/wall-system/stainless-steel.html, Last accessed Apr. 9, 2021.‡

"Nexor Modular Cladding", Nexor, pp. 1-11, https://meditek.no/wp-content/uploads/2018/10/NEXOR-Cladding-rev.01-min.pdf, Last accessed Apr. 9, 2021.‡

"Wallsand ceiling panel system", Infimed, p. 1, http://www.infimed.pl/en/walls-and-ceiling-panel-system,25.html, Last accessed Apr. 9, 2021.

"WPS-12 Stainless Steel Wall System", ProTek Systems Inc, pp. 1-6, https://www.proteksystem.com/product/wps-12-stainless-steel-wall-system/, Last accesed Apr. 9, 2021.

"Insulated metal installation guide," Ceco Building Systems, pp. 1-84, https://www.cecobuildings.com/wp-content/uploads/2018/10/Insulated-Panels-Installation-Manual.pdf, Last accessed Apr. 9, 2021.

International Search Report and Written Opinon dated May 23, 2022 for Application No. PCT/US2021/055476.

Invitation to Pay Additional Fees dated Feb. 2, 2022 for Application No. PCT/US2021/055476.

International Search Report and Written Opinion dated Jun. 1, 2022 for Application No. PCT/US2021/055564.

(56) References Cited

OTHER PUBLICATIONS

Non-Final Office Action dated Aug. 15, 2022 for U.S. Appl. No. 17/401,036.
Non-Final Office Action dated Jun. 11, 2020 for U.S. Appl. No. 16/677,449.
Final Office Action dated Oct. 27, 2020 for U.S. Appl. No. 16/677,449.
Non-Final Office Action dated Mar. 19, 2021 for U.S. Appl. No. 16/677,449.
Final Office Action dated May 14, 2021 for U.S. Appl. No. 16/677,449.
Non-Final Office Action dated Oct. 13, 2022 for U.S. Appl. No. 17/361,398.
Non-Final Office Action dated Oct. 18, 2022 for U.S. Appl. No. 17/361,417.

* cited by examiner
‡ imported from a related application

[backplates]

| Sequence | Feature | Radius | Angle | Direction | Included Angle |
|---|---|---|---|---|---|
| 1 | Contour Flange 1 | 0.040 in | 76.0 deg | Down | 104.0 deg |

| Item Number | Quantity |
|---|---|
| 1 | 1 |
| 2 | 12 |

| Sequence | Feature | Radius | Angle | Direction | Included Angle |
|---|---|---|---|---|---|
| 1 | Contour Flange 1 | 0.040 in | 104.0 deg | Down | 76.0 deg |
| 2 | Flange 1 | 0.040 in | 104.0 deg | Up | 76.0 deg |
| 3 | Bend 1 | 0.040 in | 3.0 deg | Down | 177.0 deg |

| Item Number | Title | Quantity |
|---|---|---|
| 1 | EDGE TRIM, LEFT TOP | 1 |
| 2 | EDGE TRIM BOTTOM ASM | 1 |
| 3 | 440 PAN HEAD SCREW 1/4" LONG | 12 |

| Item Number | Title | Quantity |
|---|---|---|
| 1 | EDGE TRIM, RIGHT TOP | 1 |
| 2 | EDGE TRIM BOTTOM ASM | 1 |
| 3 | 440 PAN HEAD SCREW 1/4" LONG | 12 |

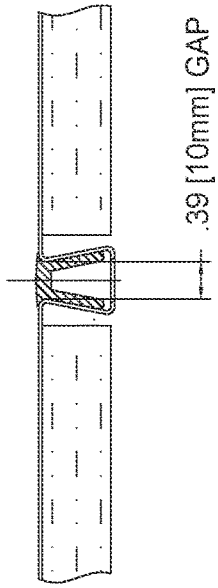
FIGURE 10A
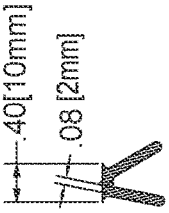
FIGURE 10B
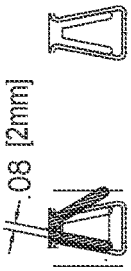
FIGURE 10C
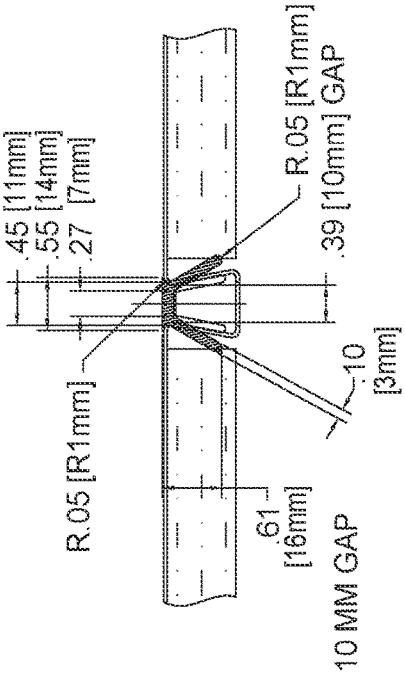
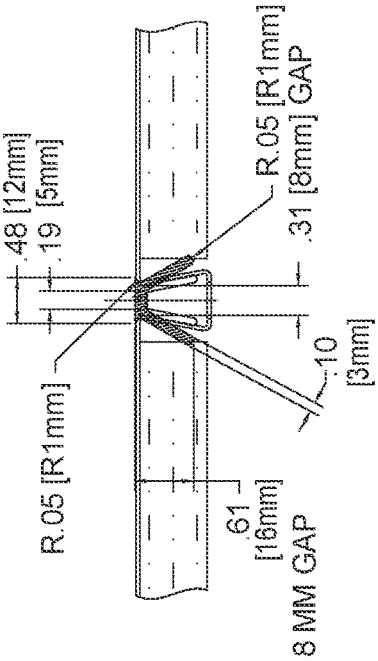
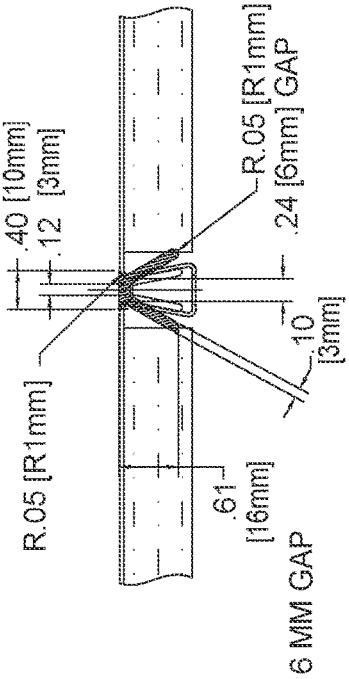

WALL SYSTEM

TECHNICAL FIELD

The disclosure relates generally to a wall system, and more specifically, to a wall system that eliminates horizontal ledges while maintaining structural integrity and hygienic properties.

BACKGROUND

Modular panel and corner systems generally include horizontal ledges and/or non-monolithic corners that fail to encapsulate panels. Additionally, the panels and the corresponding corners may not be monolithic but may rely on caulk to seal panels together. When there are changes in field conditions or the environment in which panel and corner systems can be installed, the wall systems can fail to adjust to new field conditions or a new environment. When wall systems lack adjustability, structural integrity and/or hygienic properties can become compromised. Additionally, wall systems can lack a modularity and reconfiguration ability.

SUMMARY

Embodiments of the present disclosure may provide a wall system comprising: a plurality of stainless-steel panels wrapped around moisture- and mold-resistant drywall; and a plurality of backplates that attach the plurality of panels to conventional studs, wherein the wall system eliminates horizontal ledges when installed in a room and provides clean and durable surfaces, thereby maintaining structural integrity and hygienic properties. The plurality of backplates may be formed of 16-gauge steel. Each of the plurality of stainless-steel panels may be approximately 1-2 mm in thickness and may be formed of 304L stainless steel. The plurality of stainless-steel panels may have an antimicrobial powder coat finish to enhance sterility of the panels and enhance the aesthetics of the room. The plurality of stainless-steel panels may have a flame spread of <10 and smoke developed of ≤25 for Class A fire rated. The wall system also may include aluminum extrusions, gaskets formed of ethylene propylene diene monomer (EPDM) (M-Class) rubber and having a watertight seal to make seams of the wall system monolithic, wherein the gaskets may be 6, 8 or 10 mm wide. The wall may include one or more wall constructions selected from the following: a single panel and gypsum wall; a demising wall; a 1-hour fire-rated wall; and a 1-hour double stud and gypsum wall. The wall system may include a plurality of edge trims, each of the plurality of edge trims having a contour flange. The plurality of edge trims may comprise an edge trim bottom, the contour flange having a radius of 0.040 inches at an angle of 76.0 degrees with an included angle of 104.0 degrees; and/or an edge trim left and/or right top having a contour flange with a radius of 0.040 inches at an angle of 104.0 degrees in downward direction with an included angle of 76.0 degrees according to an embodiment of the present disclosure, the edge trim left and/or right top further comprising: a flange having a radius of 0.040 inches at an angle of 104.0 degrees in an upward direction with an included angle of 76.0 degrees according to an embodiment of the present disclosure; and a bend having a radius of 0.040 inches at an angle of 3.0 degrees in a downward direction with an included angle of 177.0 degrees. The wall system also may include one or more corner pieces formed of a single panel to eliminate corner joints, wherein the one or more corner pieces may be formed at any angle, including, but not limited to, an angle selected from 90 degrees, 45 degrees, and/or 22.5 degrees. The wall system may further include one or more additional items selected from the following: monitors, white boards, windows, and doors. The wall system may be fire resistant against temperatures of up to 1700 degrees for at least 60 minutes. One of a plurality of stainless-steel panels may be replaced in as few as 30 minutes to 4 hours. Each of the plurality of stainless-steel panels may be separately replaceable.

A method for constructing a wall system may comprise adhering a plurality of stainless-steel panels to gypsum board or another substrate, wherein edges of the plurality of stainless-steel panels are turned back to cover the gypsum board or another substrate; turning back vertical seams to cover the one or more stainless panels and create a fastening flange; and pushing in one or more gaskets between the plurality of stainless-steel panels, creating a watertight seal for the wall system.

Embodiments of the present disclosure may provide a monolithic corner and/or panel adapter that may provide one or more openings that may be arranged to receive a panel. The corner and/or panel adapter may include edges that may be arranged to maintain a structural integrity when panels are secured. The corner and/or panel adapter may allow the wall system to adapt to any changing field condition while still maintaining structural and hygienic integrity. Additionally, the corner and/or panel adapter may be made of a hygienic material that may be resistant to bacteria and other components that compromise sterility.

Other embodiments of the present disclosure may provide a corner and panel system that may have one or more openings that may be arranged to receive one or more panels. A monolithic corner and/or adapter panel in the corner of the panel system may include edges that may be arranged to maintain a structural integrity when securing panels together. Additionally, a corner in the corner and panel system may be made of a hygienic material that may be resistant to bacteria and other components that compromise sterility.

Additional embodiments of the present disclosure may provide a pre-fabricated monolithic corner and/or adapter panel that may maintain structural integrity and hygienic properties.

Other technical features may be readily apparent to one skilled in the art from the following drawings, descriptions and claims.

BRIEF DESCRIPTION OF THE DRAWINGS

For a more complete understanding of this disclosure and its features, reference is now made to the following description, taken in conjunction with the accompanying drawings, in which:

FIGS. 10A-10C depict gaskets according to embodiments of the present disclosure.

DETAILED DESCRIPTION

Figure 1B:
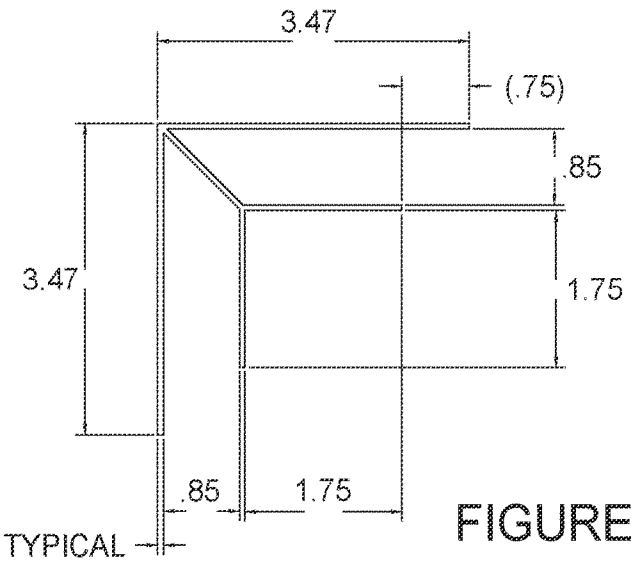
FIG. 1B depicts another corner according to an embodiment of the present disclosure.

Embodiments of the present disclosure may generally provide a wall system that may include wall cladding that may attach to conventional studs using a plurality of backplates that may span any area and provide flexibility in installation and usability after installation. Horizontal ledges in a room where a wall system is installed may be eliminated. There may be complete flexibility, as each panel of the wall system may be removable. The wall system also may provide a clean and durable surface in a high acuity area, thereby maintaining structural integrity and hygienic properties. Further, given the simplicity of installation of a wall system according to embodiments of the present disclosure, installation times may be sped up by weeks.

In embodiments of the present disclosure, the backplates forming the wall system may be 16-gauge steel; however, other gauges of steel may be used without departing from the present disclosure. Each panel may be formed of approximately 1-2 mm in thickness of ASTM A666 304 (or 304L) stainless steel having a level 4 brushed finish. While a thickness of the panel has been provided herein, it should be appreciated that the thickness may be larger or smaller without departing from the present disclosure.

In addition, while a specific stainless steel has been described herein, the panel may be formed of one or more materials including, but not limited to, extruded aluminum, stainless steel, and other materials without departing from the present disclosure. Regardless what material(s) may be used to form each panel, it should be sterile and provide hygienic properties when used in the field, such that it may not require further sterilization for use in sensitive environments including, but not limited to, operating rooms or other locations where access to sterile environments may be unavailable or less available. Further, regardless whether stainless steel or another material is used to form the panels, it should be appreciated that the material should have a surface hardness of approximately 750 HV with a minimum bending angle of 5 degrees, and a minimum breaking torque of 16 kg-cm in embodiments of the present disclosure.

In embodiments of the present disclosure, the stainless steel may be provided with an antimicrobial powder coat finish to enhance the sterility of the stainless steel. Finishes containing one or more colors also may be provided in embodiments of the present disclosure. While different finishes of the panels have been described herein, it should be appreciated that other finishes may be provided without departing from the present disclosure.

It should be appreciated that panels used in a wall system according to embodiments of the present disclosure may be tested in accordance with ASTM E84 for surface burning characteristics. Panels shall have a flame spread of <10 and smoke developed of ≤25 for Class A fire rated. Panels also may be able to accommodate the increase or decrease in width, due to variations between plan and field dimensions, while maintaining all original properties. Panels may have a stretcher-leveled standard of flatness.

The stainless steel or other material forming a panel may be wrapped around moisture- and mold-resistant drywall. Interior gypsum board used in a wall system according to embodiments of the present disclosure may be ⅝" Type X moisture- and mold-resistant panels for use on walls. It should comply with ASTM C1177, C1396, C1658 and D3273. In embodiments of the present disclosure, gypsum board or drywall products may include, but are not limited to, USG Sheetrock Brand Mold Tough Panels Firecode X, USG Brand UltraLight Panels Mold Tough Firecode X, and/or Georgia-Pacific ToughRock Fireguard X Mold-Guard Gypsum Board. While certain brands of drywall have been described herein, it should be appreciated that other brands or similar types of drywall may be used without departing from the present disclosure. Other substrates, including, but not limited to, reinforced moisture-resistant substrates, fiberglass-reinforced drywall or a honeycomb structural material, may be used as well. Further, while a certain thickness of drywall or gypsum board has been described herein, it should be appreciated that drywall having greater or less thickness may be used without departing from the present disclosure.

A wall system according to embodiments of the present disclosure may include aluminum extrusions. In an embodiment of the present disclosure, these extrusions may be ASTM B221/B221M, with alloy and temper required to suit structural and finish requirements.

Gaskets also may be provided for a wall system according to embodiments of the present disclosure. These gaskets may be formed of ethylene propylene diene monomer (EPDM) (M-Class) rubber or silicone. However, other similar materials may be used for gaskets without departing from the present disclosure. The gaskets may be compression only, such that no tools may be needed for easy access. Silicone gaskets may be provided that may be 6, 8, or 10 mm wide in embodiments of the present disclosure (FIGS. 10A-10C). While various dimensions are provided in FIGS.

10A-10C, it should be appreciated that other widths and dimensions may be provided without departing from the present disclosure. Gaskets may have a watertight seal to make the seam monolithic. Finishes for gaskets may vary.

Figure 3A:
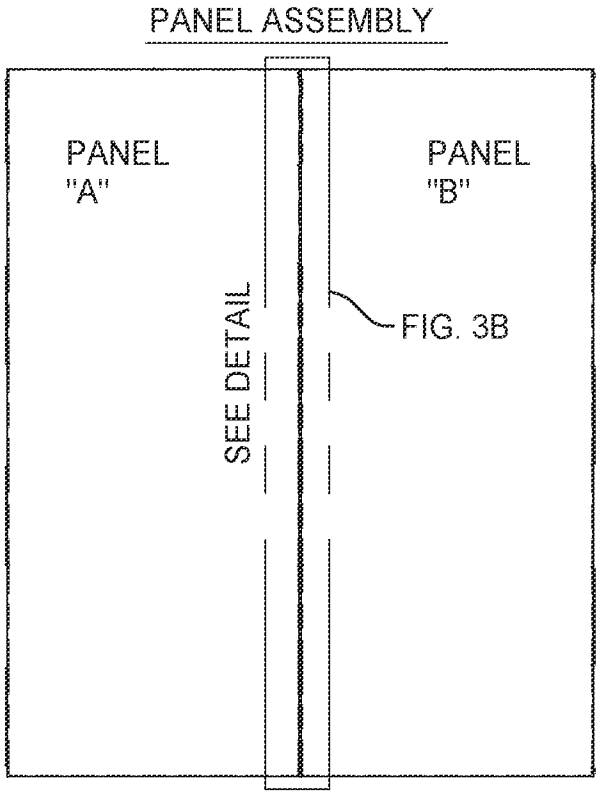
FIG. 3A depicts a panel assembly according to an embodiment of the present disclosure.
Figure 3B:
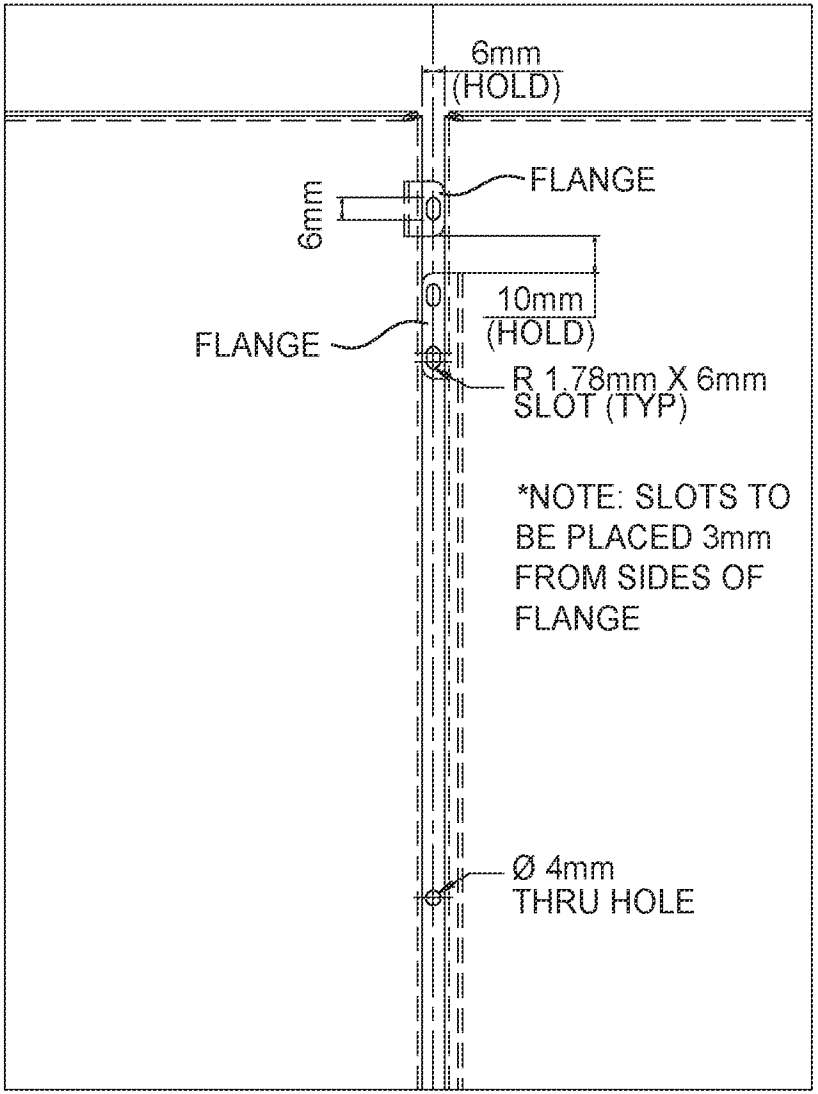
FIG. 3B depicts an exploded view of a connection between panels within the panel assembly of FIG. 3A according to an embodiment of the present disclosure.
Figure 3C:
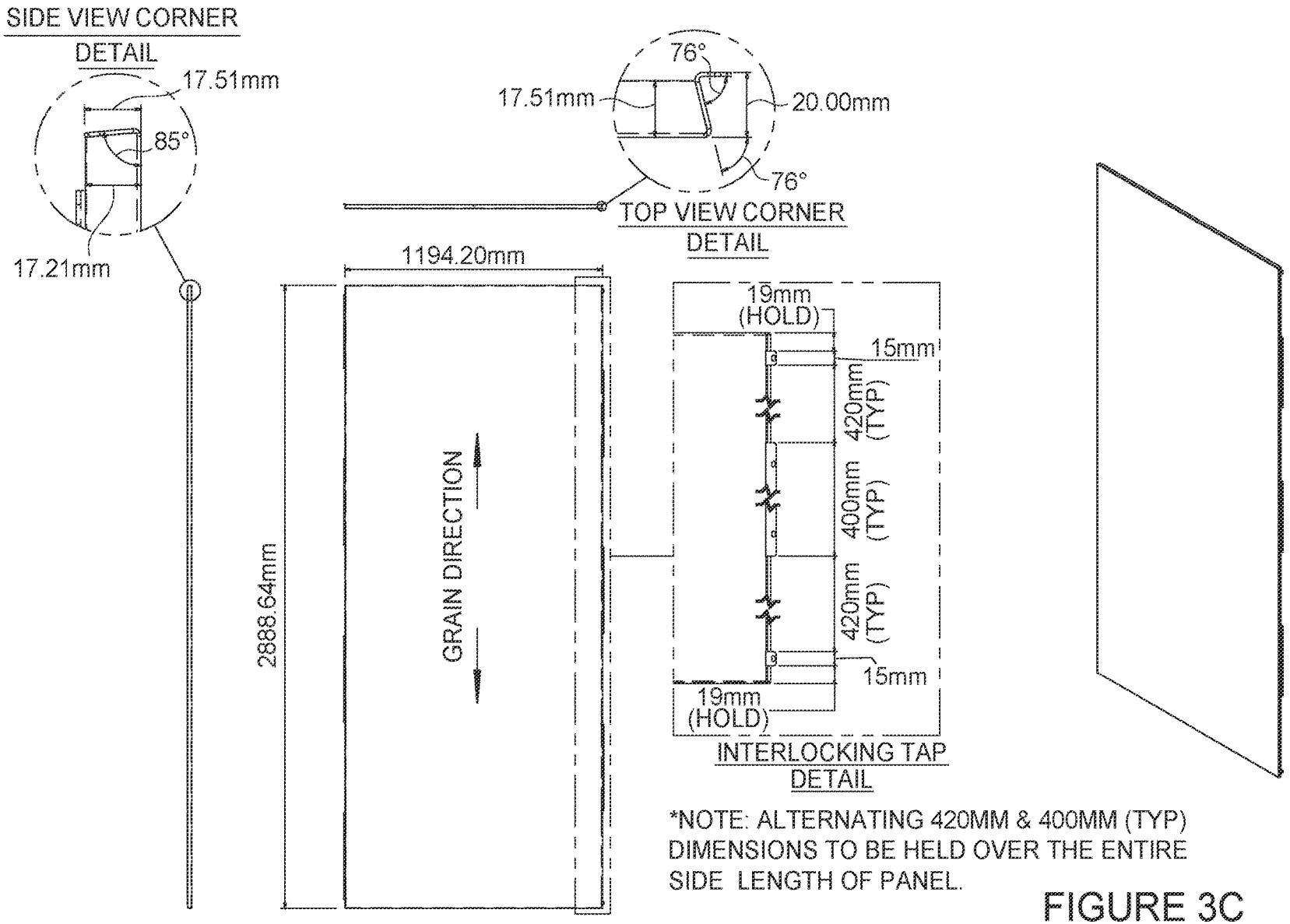
FIG. 3C depicts another view of a standard profile flat panel according to an embodiment of the present disclosure.

FIG. 3A depicts a panel assembly according to an embodiment of the present disclosure. Each panel may be installed separately with an A and a B side so that it may be easily removed. As depicted herein, there may be two panels (Panel "A" and Panel "B") that may be joined together. FIG. 3B depicts an exploded view of a connection between Panel "A" and Panel "B" within the panel assembly of FIG. 3A. The panels may be installed with screws, such as T-10 stainless steel screws or other types of screws, and may be screwed off at or attached to the backplate location on the tabs. FIG. 3C depicts another view of a standard profile flat panel according to an embodiment of the present disclosure. More specifically, FIG. 3C provides exploded views of a side view corner detail, a top view corner detail, and interlocking tap detail. While specific dimensions and/or angles are provided in FIG. 3C, it should be appreciated that different dimensions and/or angles may be utilized without departing from the present disclosure.

Figure 4A:
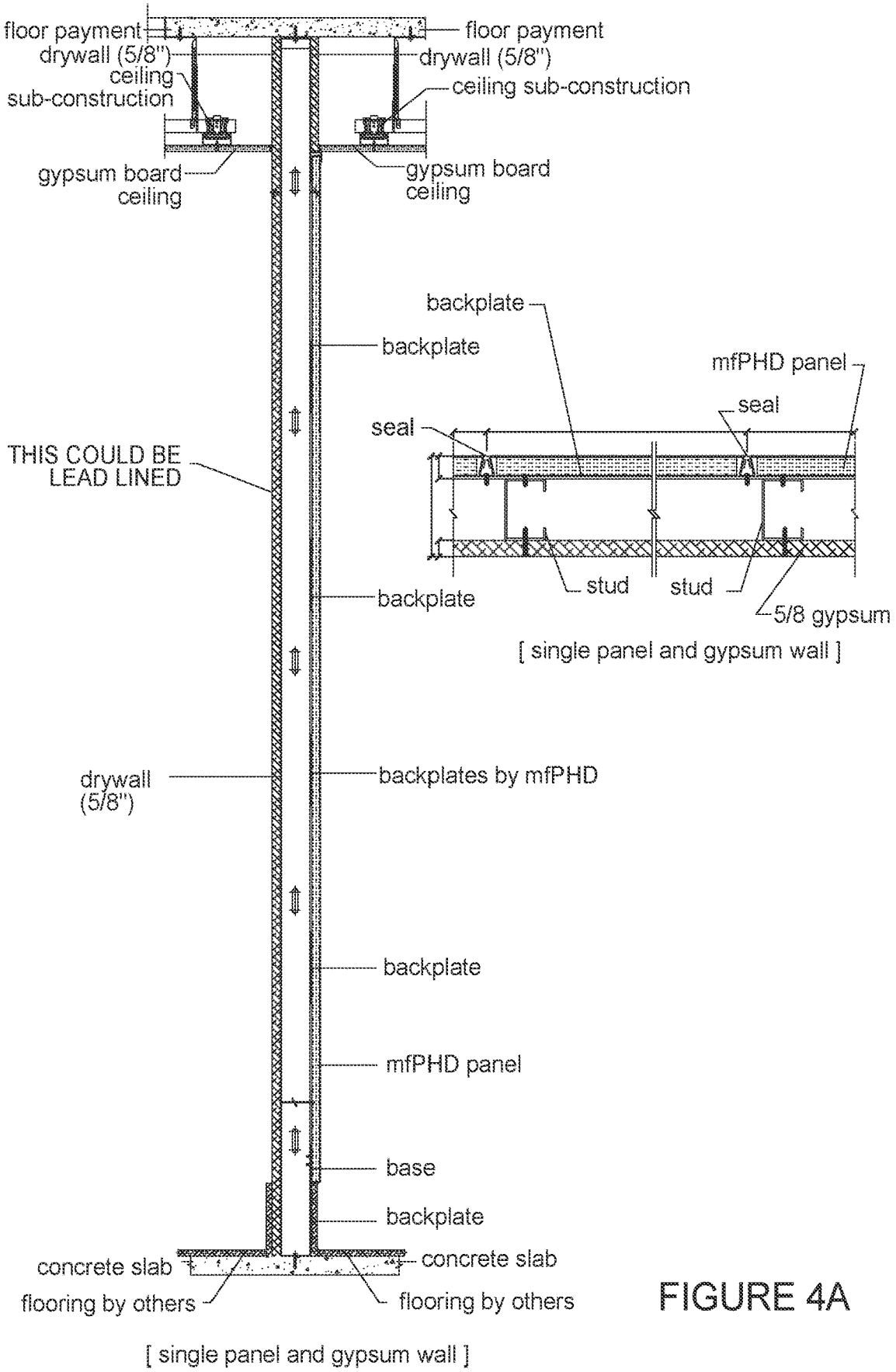
FIG. 4A depicts construction of a single panel and gypsum wall according to an embodiment of the present disclosure.
Figure 4B:
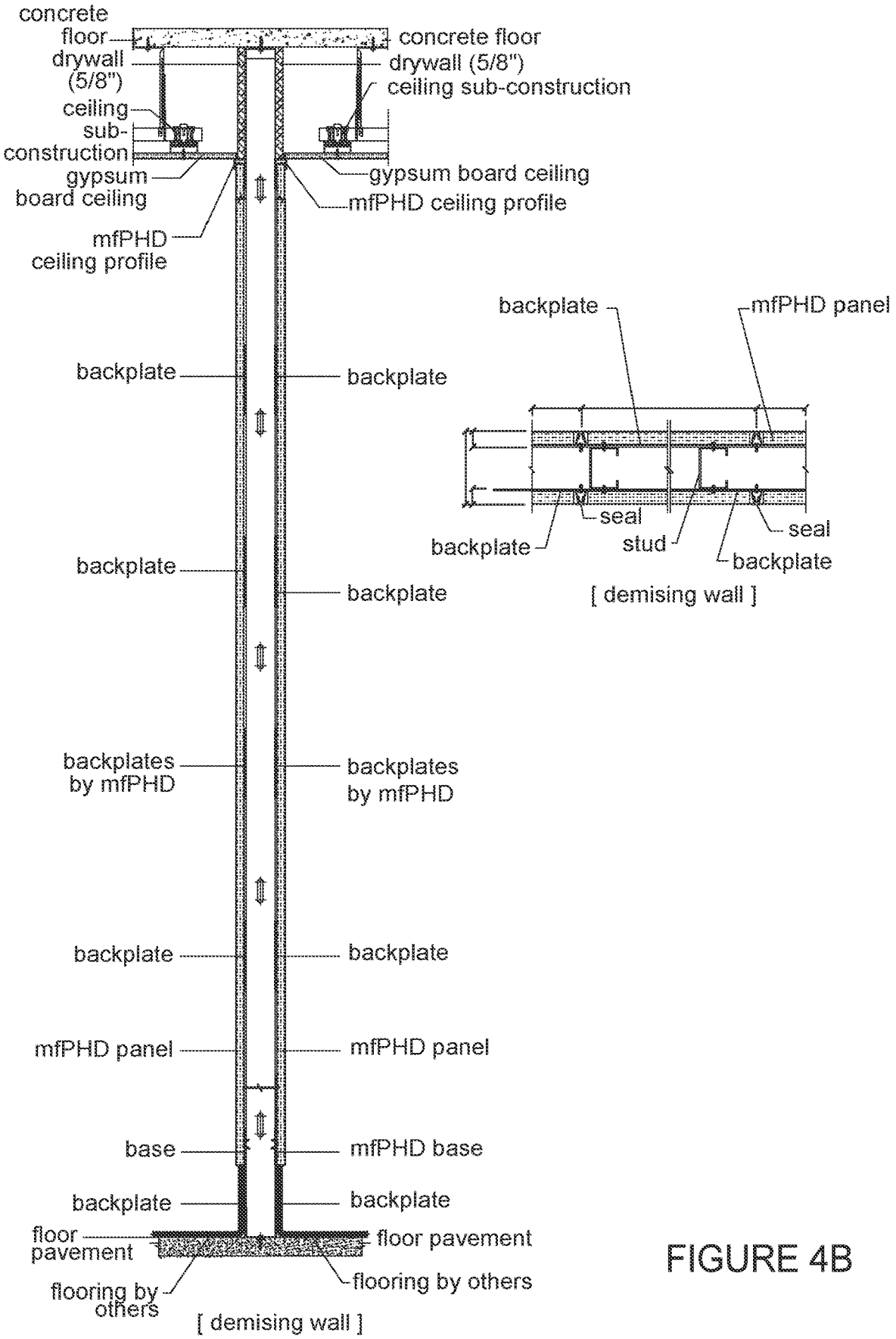
FIG. 4B depicts a demising wall according to an embodiment of the present disclosure.
Figure 4C:
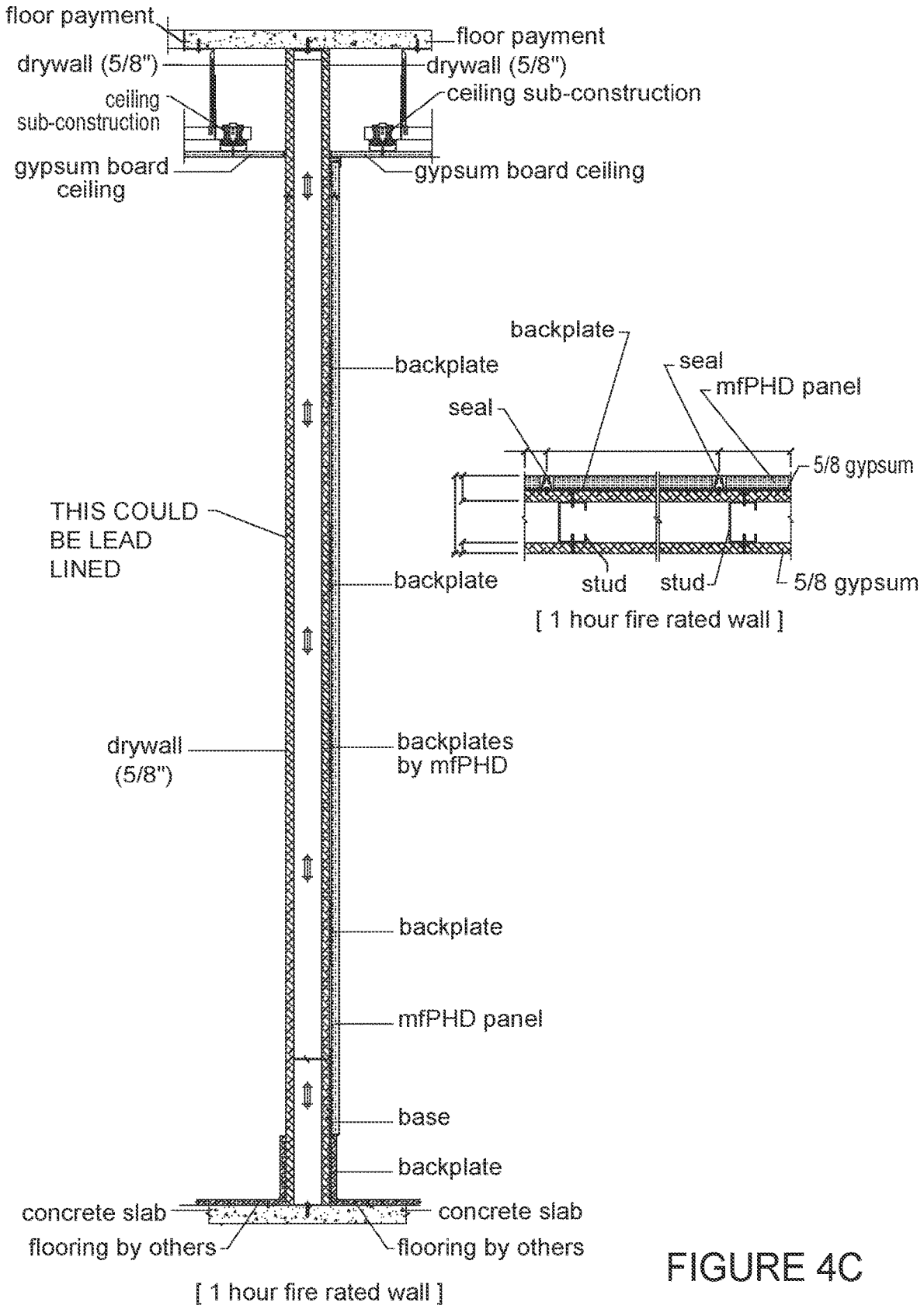
FIG. 4C depicts a 1-hour fire-rated wall according to an embodiment of the present disclosure.
Figure 4D:
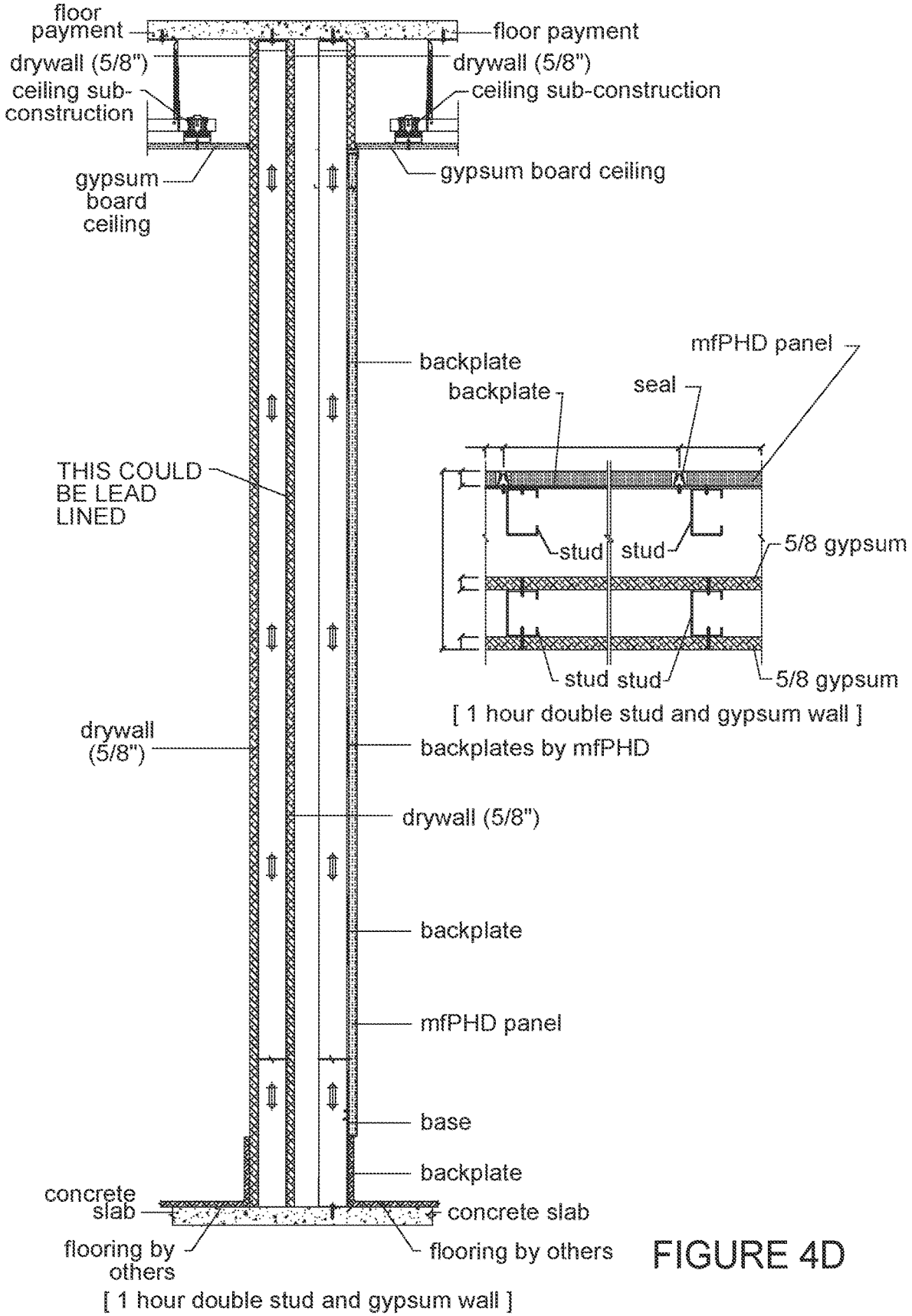
FIG. 4D depicts a 1-hour double stud and gypsum wall according to an embodiment of the present disclosure.
Figure 5:
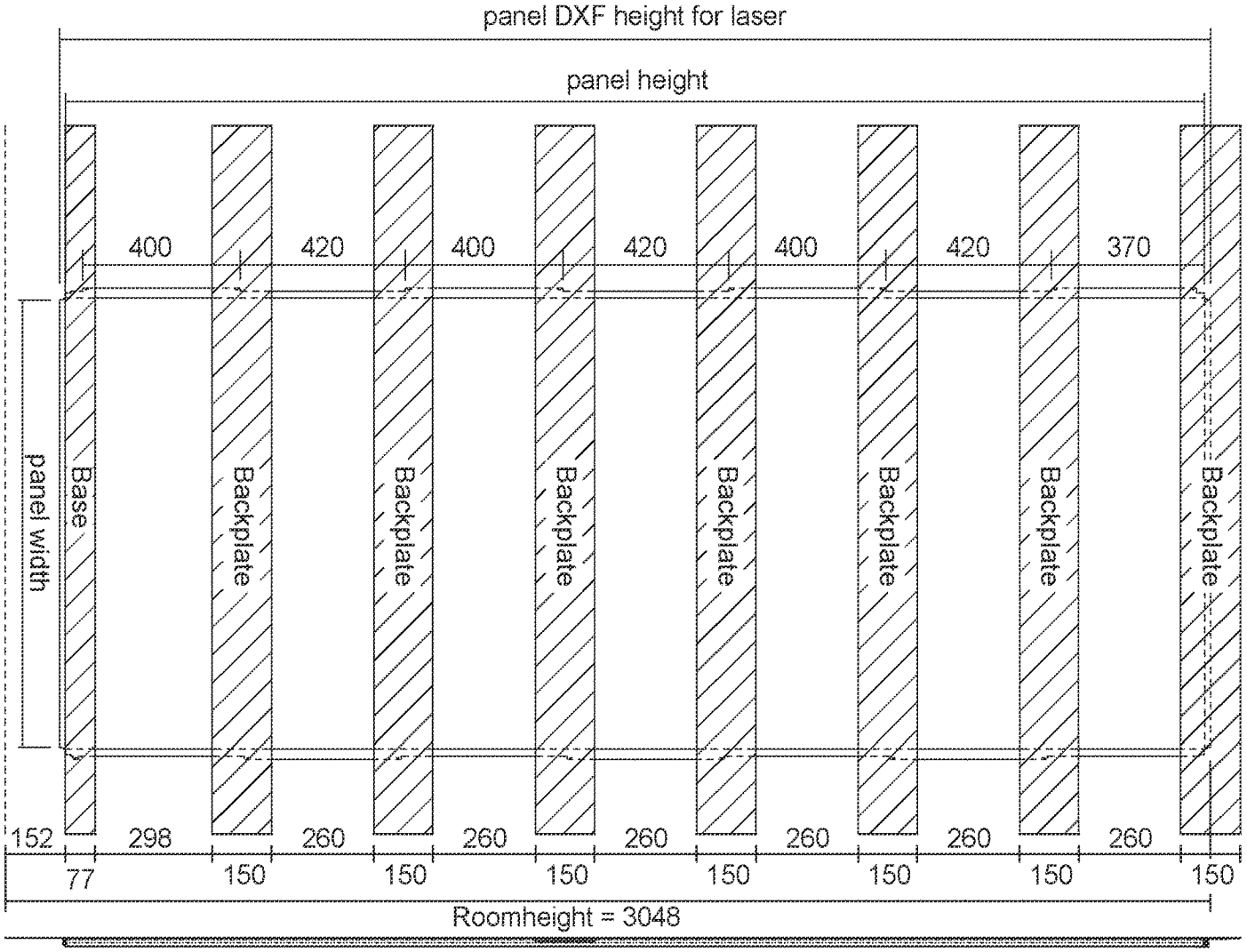
FIG. 5 depicts spacing of the plurality of baseplates and the base of FIG. 4A according to an embodiment of the present disclosure.

FIGS. 4A-4D depict various wall constructions for wall systems according to embodiments of the present disclosure. More specifically, FIG. 4A depicts construction of a single panel and gypsum wall according to an embodiment of the present disclosure. The gypsum wall may extend vertically from a concrete slab floor to a gypsum board ceiling. A plurality of backplates may be positioned behind the single panel. The plurality of backplates may be equally distanced from one another in some embodiments of the present disclosure; however, there may be other embodiments of the present disclosure where the plurality of backplates may be unequally spaced. The wall system also may include a base in addition to the plurality of base plates as depicted in FIG. 4A. FIG. 5 depicts spacing of the plurality of baseplates and the base of FIG. 4A according to an embodiment of the present disclosure. FIG. 4B depicts a demising wall according to an embodiment of the present disclosure. This wall may be used to separate spaces, such as separating the operating room from common areas such as public corridors or hallways. Similar to FIG. 4A, a plurality of backplates may be provided as well as a base with respect to each panel. A ceiling profile also may be provided. FIG. 4C depicts a 1-hour fire-rated wall according to an embodiment of the present disclosure. As with FIGS. 4A-4B, a plurality of backplates as well as a base may be provided with respect to a panel; however, in FIG. 4C, more than one drywall piece may be provided so as to improve the fire rating of the wall system in an embodiment of the present disclosure. FIG. 4D depicts a 1-hour double stud and gypsum wall according to an embodiment of the present disclosure. Similar to FIG. 4C, more than one gypsum wall may be provided. In an embodiment of the present disclosure, an interior gypsum wall may be lead-lined.

Figure 6A:
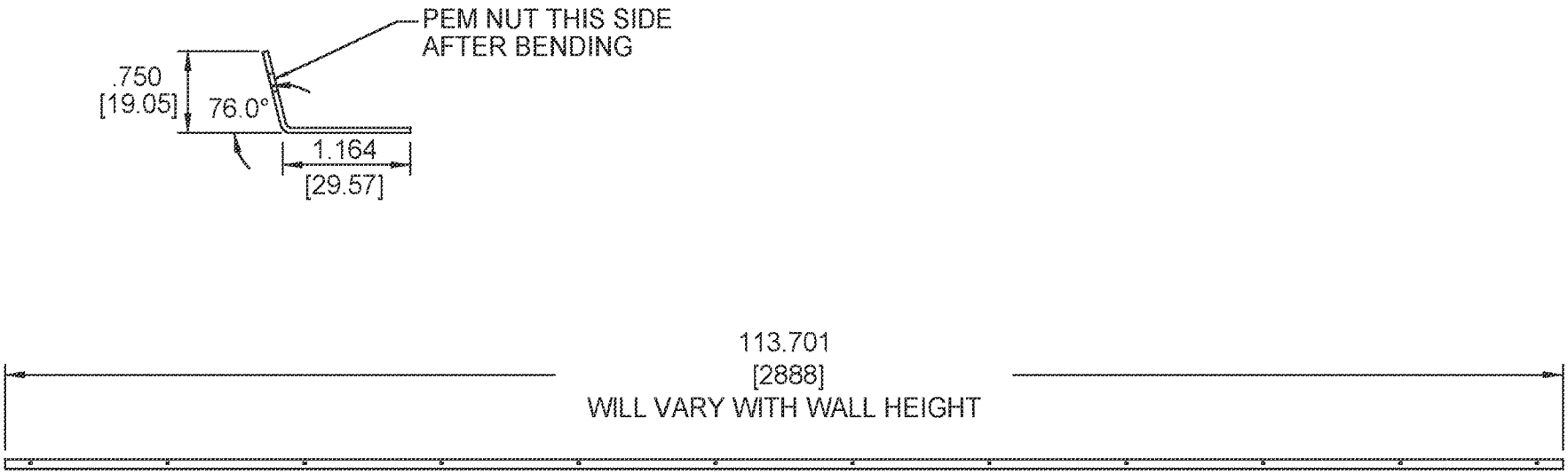
FIGS. 6A-6C depict an edge trim bottom according to an embodiment of the present disclosure.
Figure 6B:
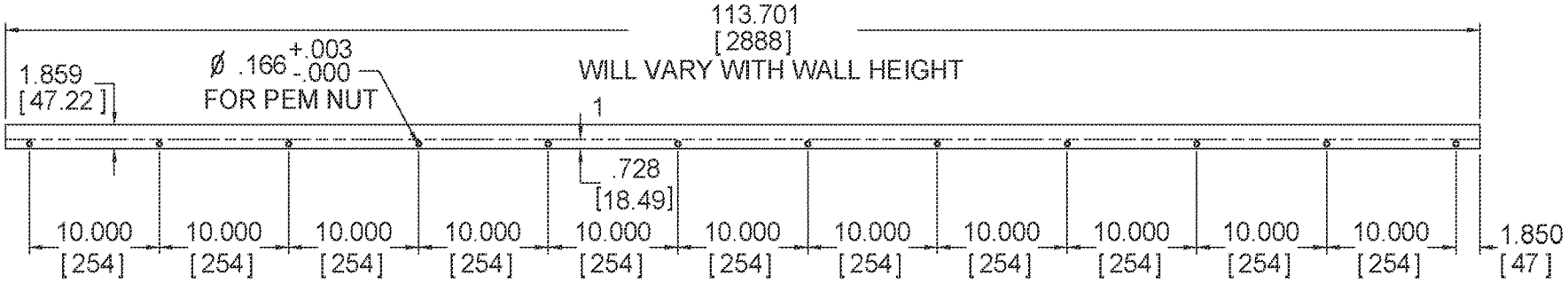
Figure 6C:
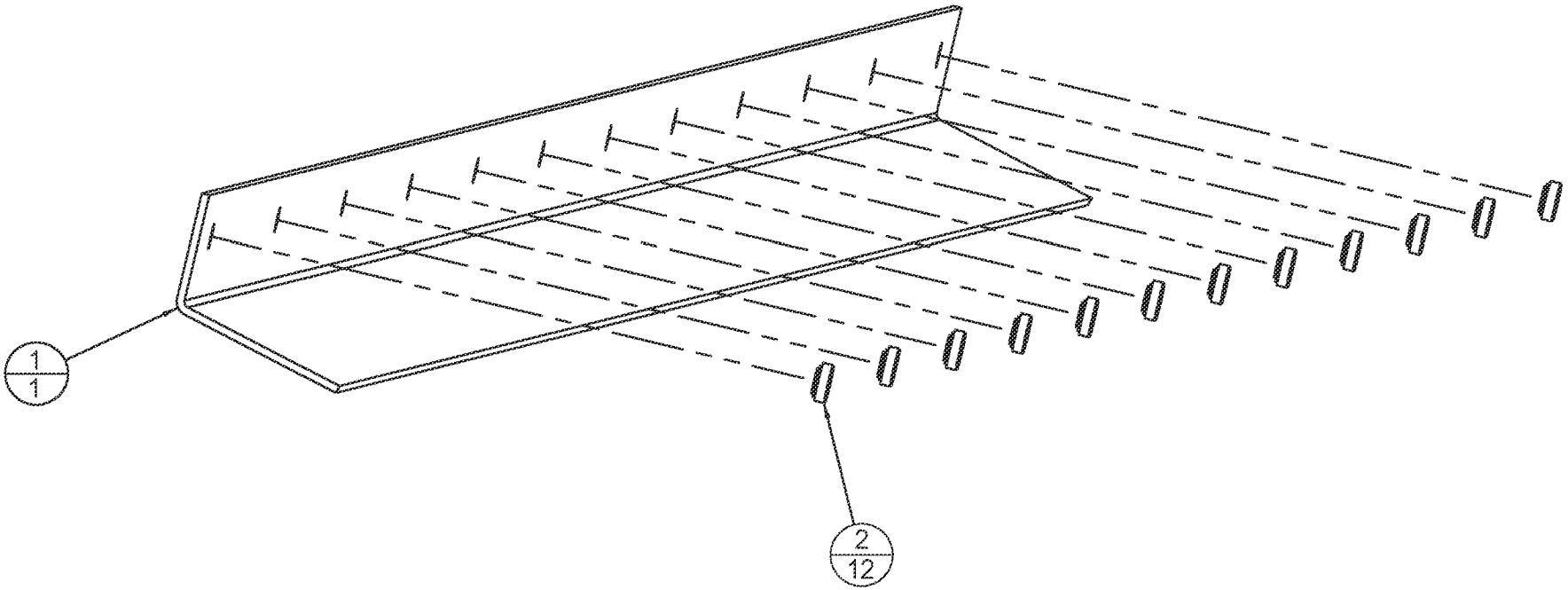
Figure 6D:
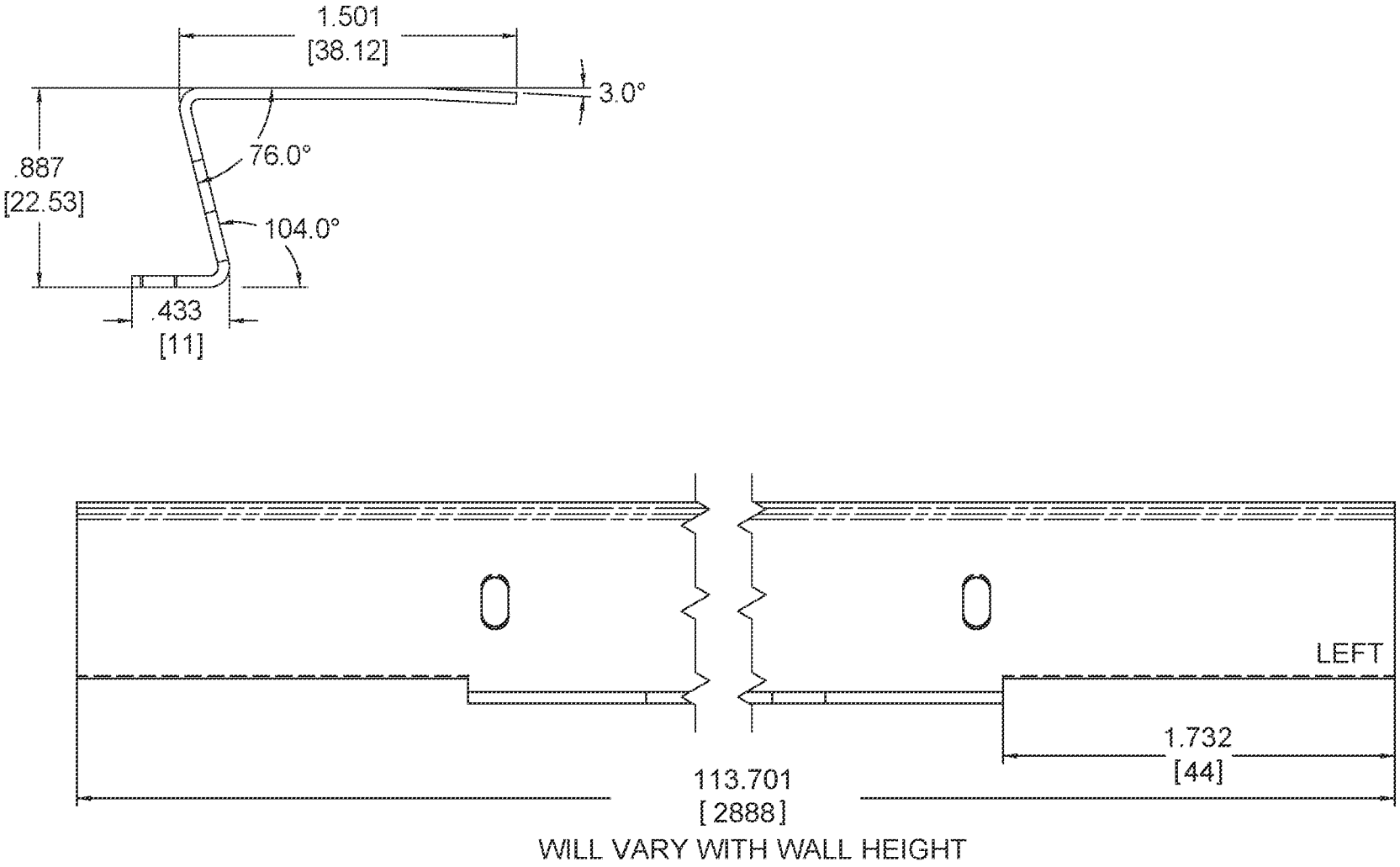
FIG. 6D-6E depicts an edge trim left top according to an embodiment of the present disclosure.
Figure 6E:
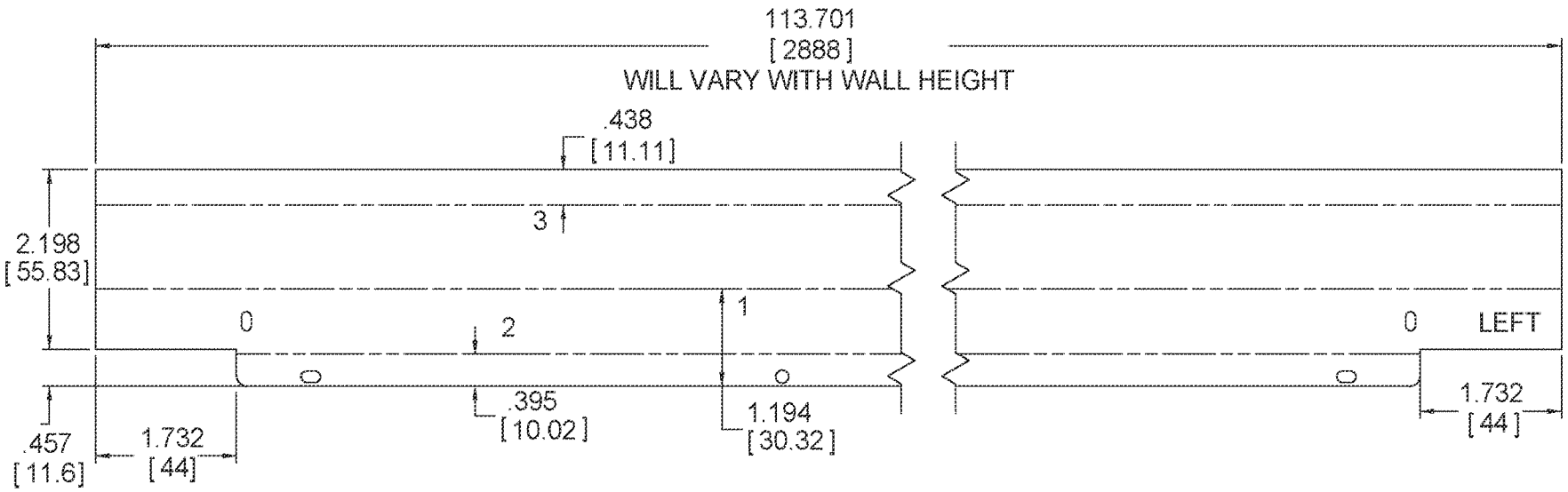
Figure 6F:
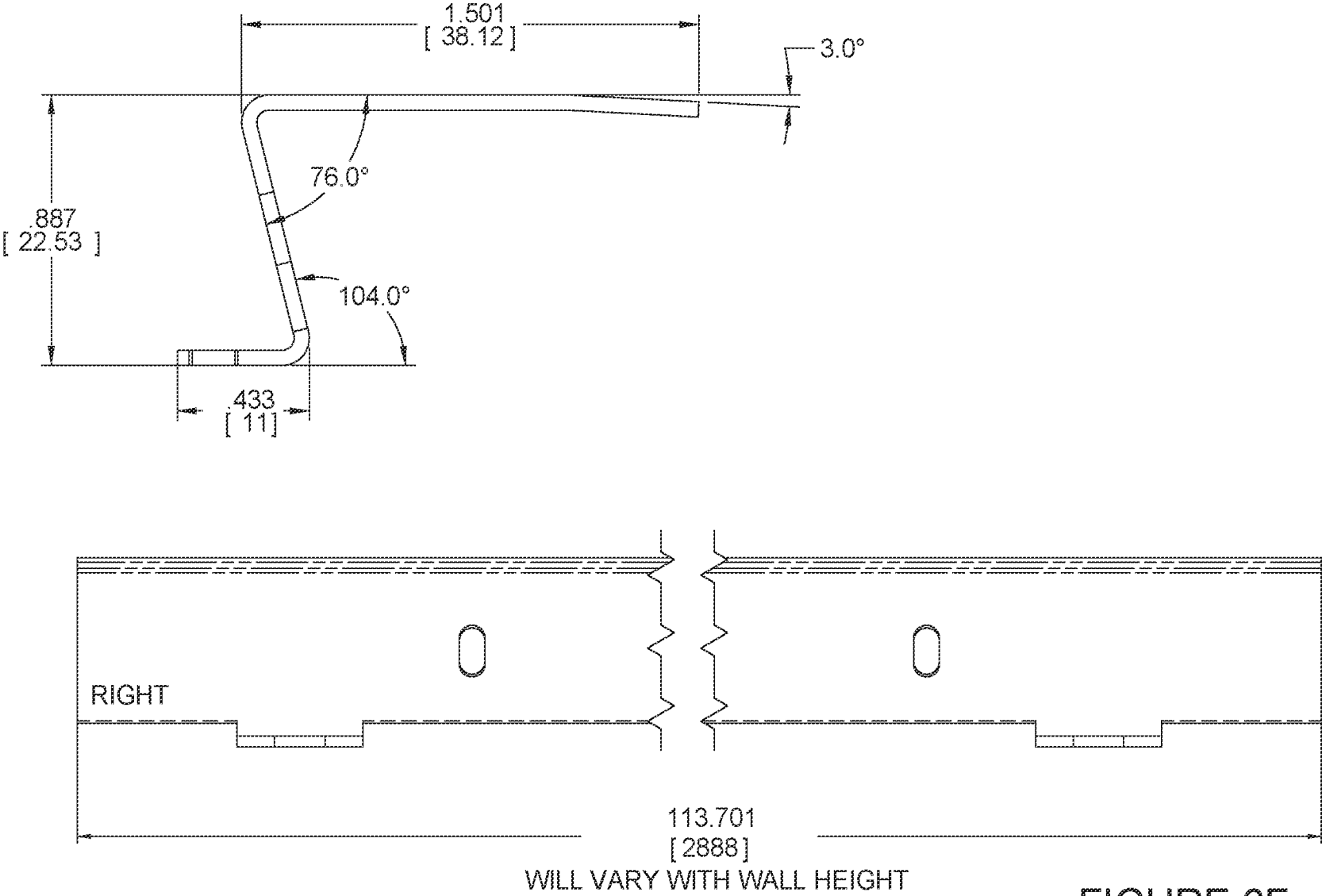
FIGS. 6F-6G depict an edge trim right top according to an embodiment of the present disclosure.
Figure 6G:
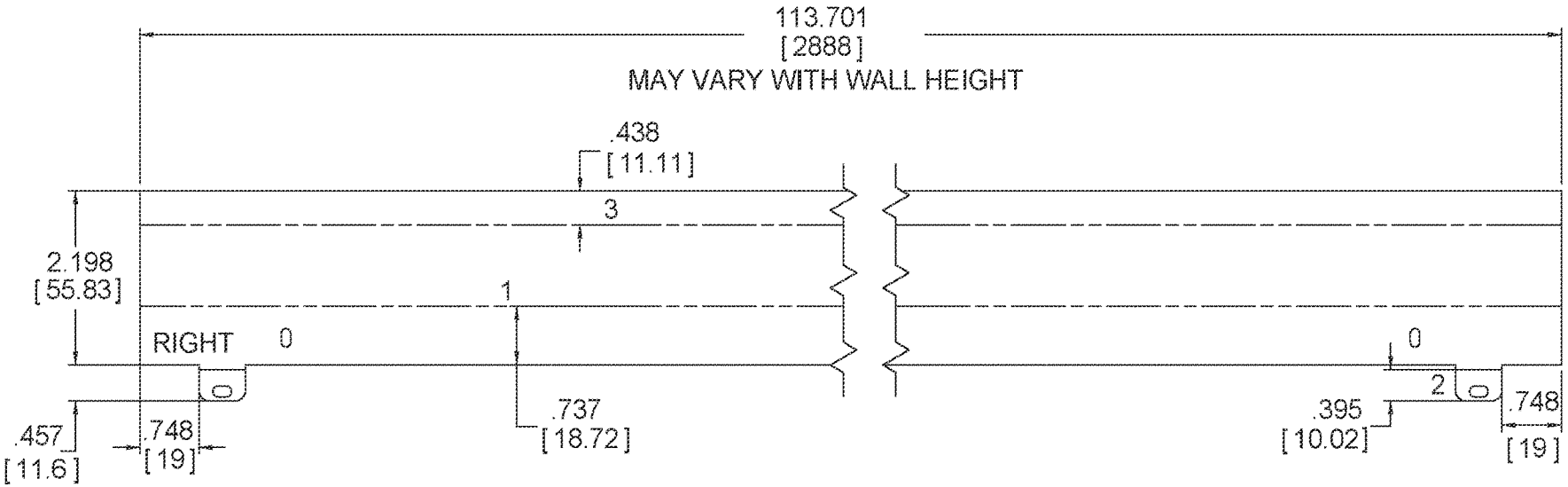
Figure 6H:
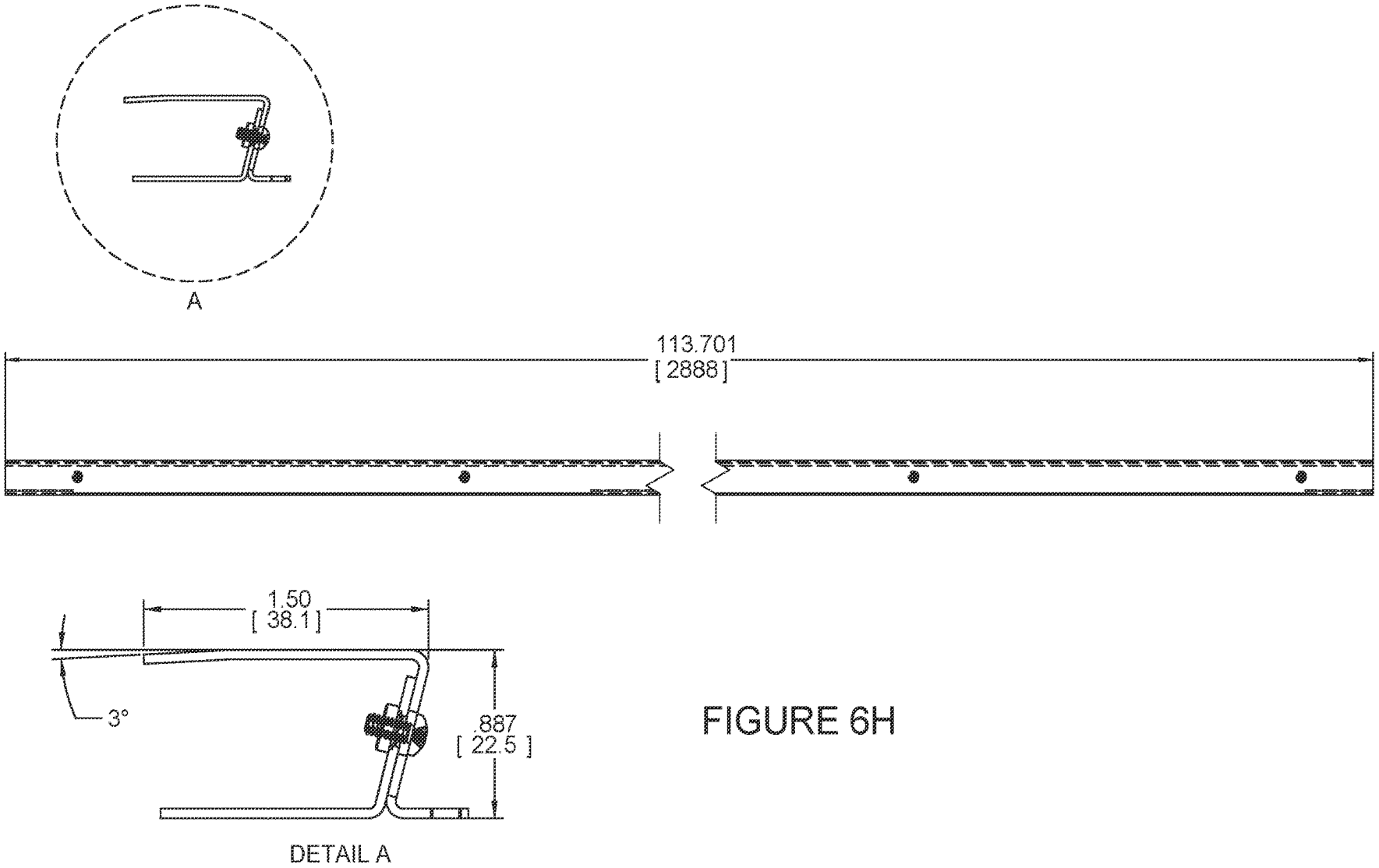
FIGS. 6H-6K depict edge trim according to an embodiment of the present disclosure.
Figure 6I:
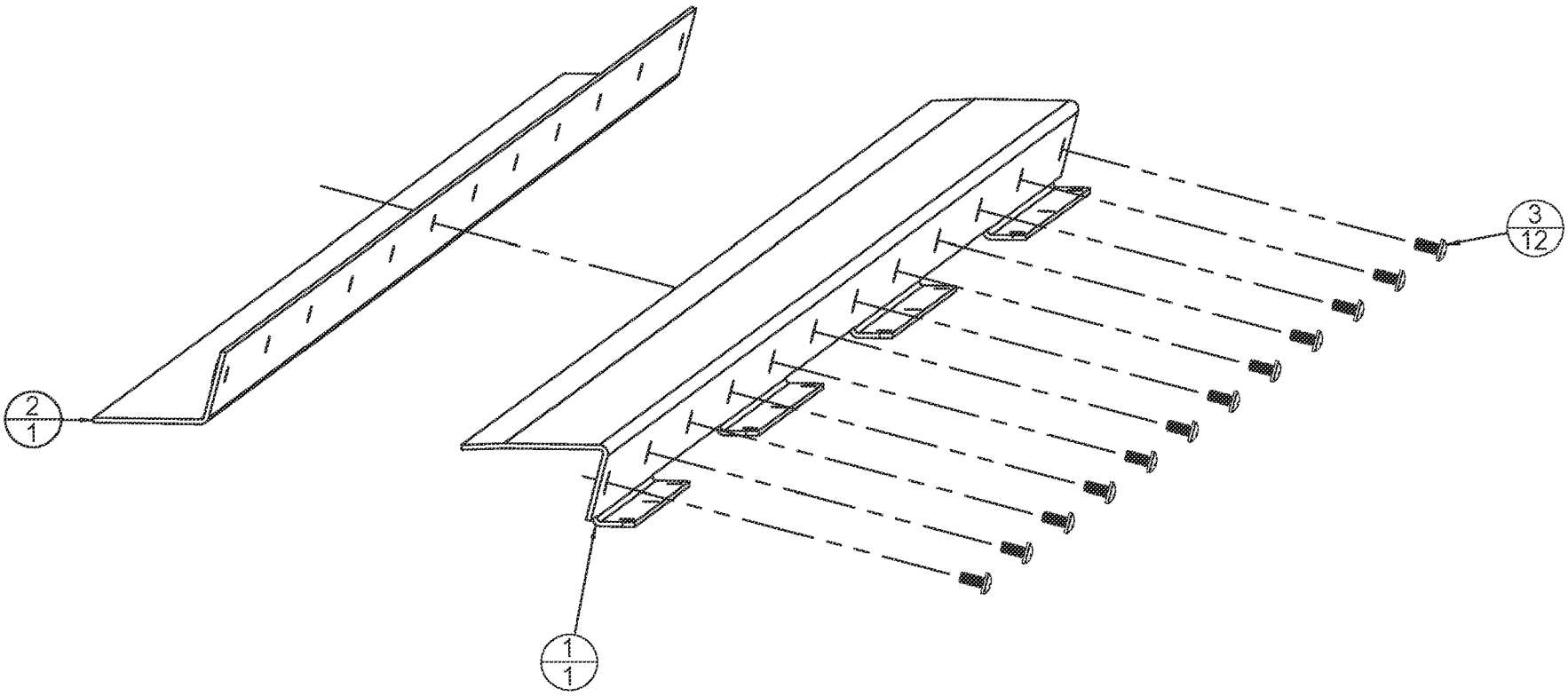
Figure 6J:
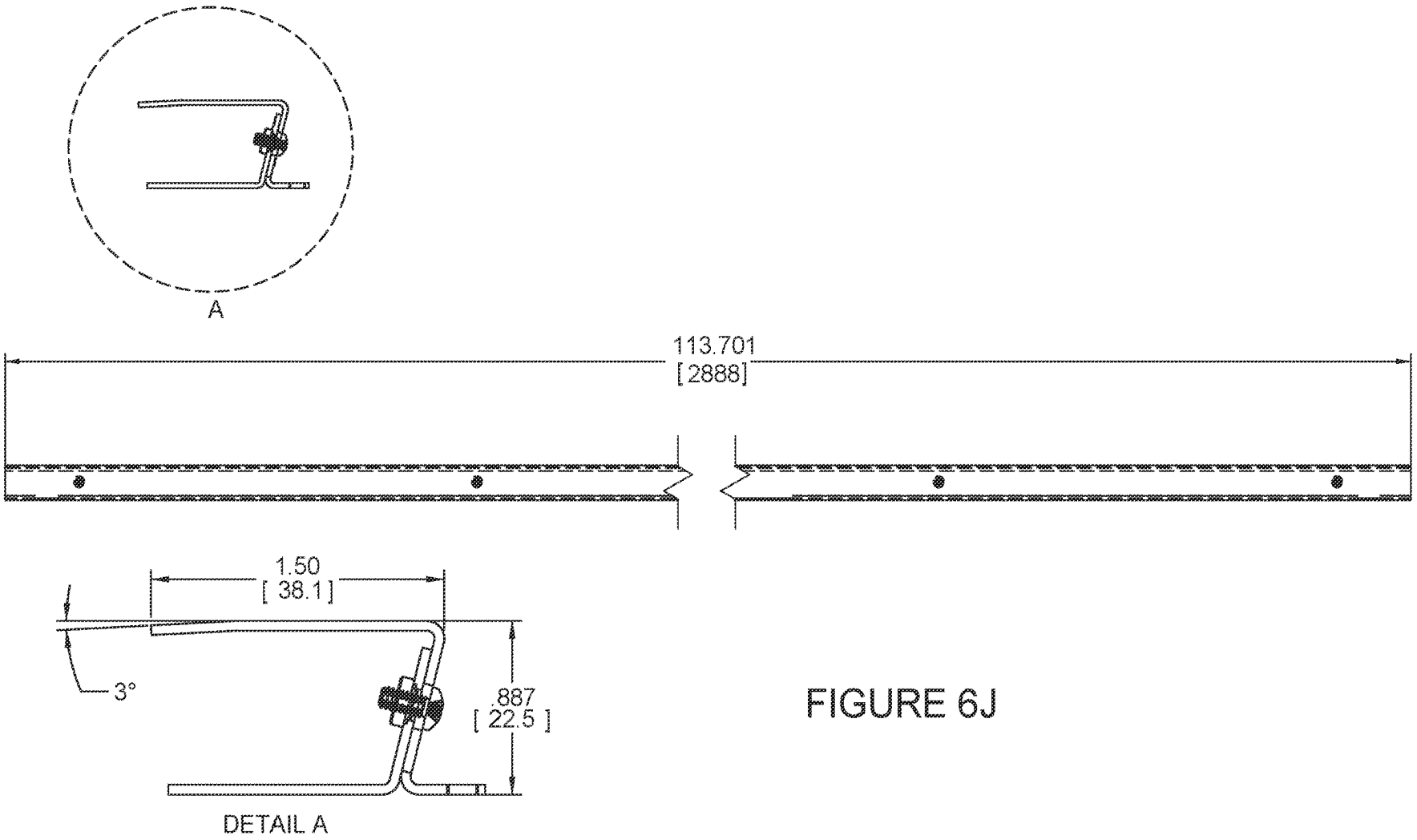
Figure 6K:
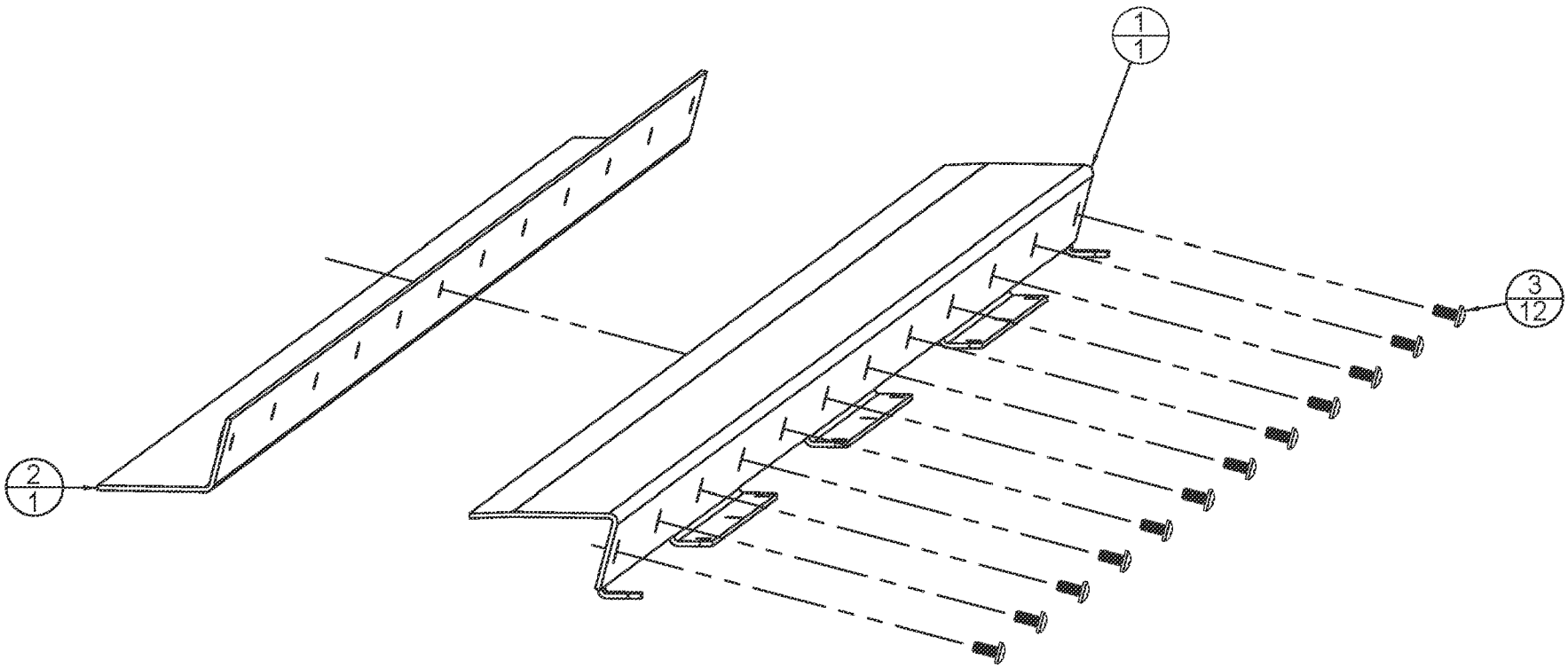

FIGS. 6A-6K depict edge trims according to embodiments of the present disclosure. FIGS. 6A-6C depict an edge trim bottom according to an embodiment of the present disclosure. As depicted herein, contour flange 1 may have a radius of 0.040 inches at an angle of 76.0 degrees with an included angle of 104.0 degrees according to an embodiment of the present disclosure. FIGS. 6D-6E depict an edge trim left top according to an embodiment of the present disclosure. Contour flange 1 may have a radius of 0.040 inches at an angle of 104.0 degrees in downward direction with an included angle of 76.0 degrees according to an embodiment of the present disclosure. Flange 2 may have a radius of 0.040 inches at an angle of 104.0 degrees in an upward direction with an included angle of 76.0 degrees according to an embodiment of the present disclosure. Bend 3 may have a radius of 0.040 inches at an angle of 3.0 degrees in a downward direction with an included angle of 177.0 degrees in an embodiment of the present disclosure. FIGS. 6F-6G depict an edge trim right top according to an embodiment of the present disclosure. Edge trim right top may include similar radii and angles for contour flange 1, flange 2, and bend 3 as discussed with respect to FIGS. 6D-6E. FIGS. 6H-6K depict edge trim according to an embodiment of the present disclosure. While various dimensions, spacings, and/or angles are provided in FIGS. 6A-6K, it should be appreciated that they may vary depending on factors including, but not limited to, wall height.

In embodiments of the present disclosure, the wall system may be constructed by adhering a stainless-steel panel to a substrate, such as gypsum board or fiberglass-backed drywall or other similar substrates. All edges of each panel may be turned back to cover the gypsum board. The vertical seams may also be turned back to cover the panel and then turned to create a fastening flange. Gaskets may be pushed in manually between panels so as to create a watertight seal for the wall system according to embodiments of the present disclosure.

There may be inside and outside corners used to form a wall system according to embodiments of the present disclosure. It should be appreciated that inside and outside corners may be solid piece construction as described in more detail, for example, in FIGS. 1-2 as well as FIGS. 7A-7D. It should also be appreciated that different angles for corners may be used in embodiments of the present disclosure. These angles may include, but are not limited to, 90 degrees, 45 degrees, and/or 22.5 degrees, and these angles may be formed out of a single panel to eliminate corner joints. However, other angles may be used without departing from the present disclosure.

Figure 1A:
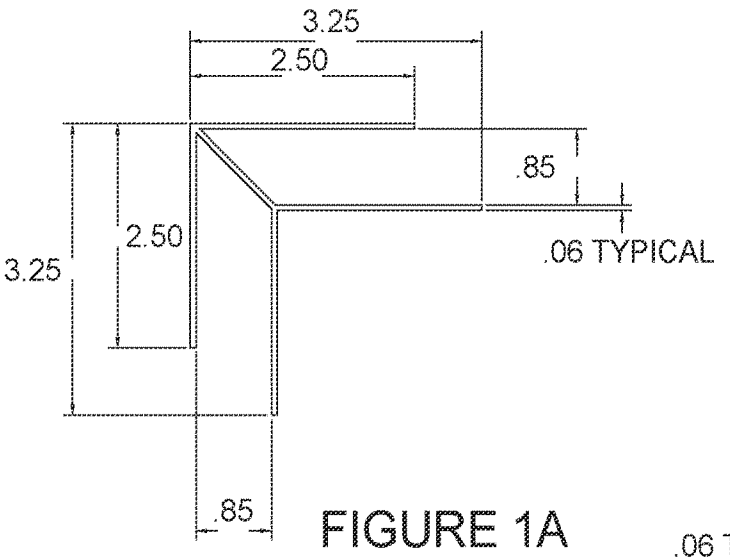
FIG. 1A depicts a corner according to an embodiment of the present disclosure.
Figure 2B:
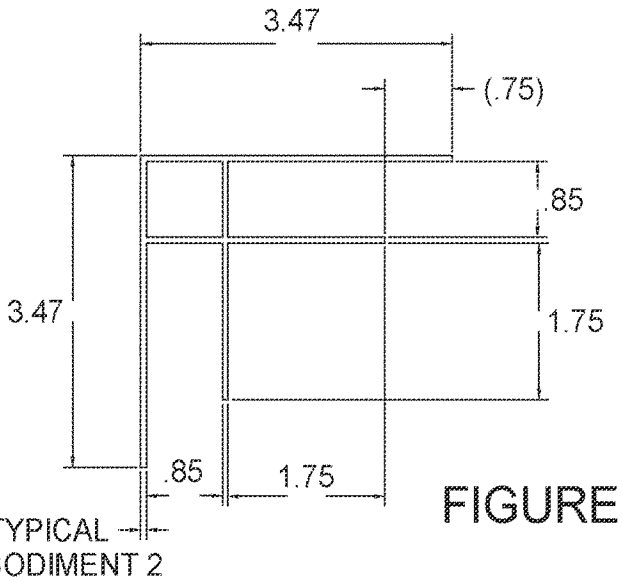
FIG. 2B depicts a corner according to an embodiment of the present disclosure.
Figure 2A:
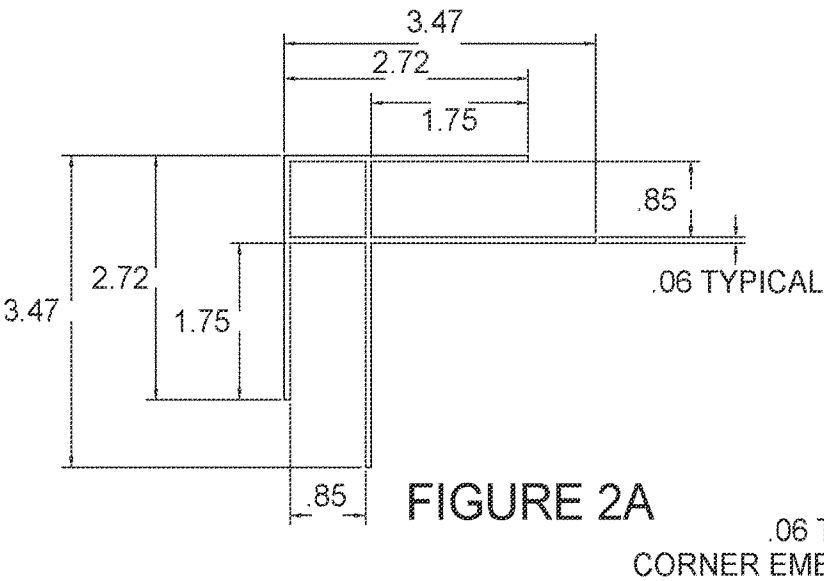
FIG. 2A depicts an additional corner according to an embodiment of the present disclosure.

FIGS. 1A-1B depict a monolithic corner according to an embodiment of the present disclosure. In some embodiments of the present disclosure, the corner may be prefabricated. It should be appreciated that the corner may be made of one or more materials including, but not limited to, extruded aluminum, stainless steel, and other materials. It should also be appreciated that the one or more materials may be sterile and may not require further sterilization for use in sensitive environments including, but not limited to, operating rooms. For example, the one or more materials may be sterile and may provide hygienic properties when used in the field, including, but not limited to, locations where access to sterile environments may be unavailable or less available. The corner may be configured to allow one or more panels and/or additional structural components to adjust or undergo modifications as desired.

The corner may be configured to encapsulate the one or more panels and may provide a solid monolithic receiver in embodiments of the present disclosure. It should be appreciated that the one or more panels may be encapsulated by sealing an entirety of an edge of the one or more panels. In some embodiments of the present disclosure, a single line of caulk may be used to seal the one or more panels to the corner. However, there may be other embodiments of the present disclosure where foam and/or a flat gasket may be used in place of or in addition to the caulk. Use of foam may add an additional layer of protection that may enhance the structural integrity of the panel and corner system.

The corner and/or adapter panel may provide a solid monolithic receiver along a plurality of edges or sides of the corner in embodiments of the present disclosure. Additionally, the corner and/or adapter panel may maintain its structural integrity and hygienic properties. The structural integrity of the corner and/or adapter panel may provide enough strength to ensure the one or more panels remain secure, regardless how the panels may be configured and/or re-configured. The hygienic properties of the corner and/or adapter panel may ensure that any configuration of corners and the one or more panels will be sterile and safe for sensitive environments including, but not limited to, hospitals, clean rooms, pharmacies, cafeteria, sterile processing department, radiological environments, operating rooms, and other environments or settings.

A pre-fabricated monolithic corner and/or adapter panel may provide flexibility to adjust a connected panel or plurality of panels for any room size according to an embodiment of the present disclosure. It should be appreciated that the connected panel or plurality of panels may have a finish that may be stainless steel. It should also be appreciated that the connected panel or plurality of panels may have a finish that may be galvanized, powder-coated, or not powder-coated. However, other types of finishes and/or coatings and combinations of the same may be used without departing from the present disclosure.

In some embodiments of the present disclosure, the connected panel or the plurality of panels may have a standard size. In such instances, the connected panel or the plurality of panels may each utilize the same solid monolithic receiver that may be provided by the corner. However, the solid monolithic receiver provided by the corner and/or adapter panel may be provided in different sizes and/or thicknesses to receive panels having different sizes in embodiments of the present disclosure.

A corner and panel system may include a pre-fabricated monolithic corner and/or adapter panel that may provide an opening to receive the panel according to an embodiment of the present disclosure. The opening may also be referred to as a throat and may be provided in a plurality of sizes to receive different types, sizes, and/or thicknesses of panels in embodiments of the present disclosure. It should be appreciated that a depth of the throat may be plus or minus approximately one millimeter in some embodiments of the present disclosure and may effectively seal the panel without use of a caulk or foam; however, caulk and/or foam may be used without departing from the present disclosure.

In some embodiments of the present disclosure, the corner or components thereof may be cut in the field so as to be adaptable to the needs in the field. However, there are other embodiments where the corner or components thereof may be pre-cut prior to being used in the field. It should be appreciated that a height of the corner and/or a corner and panel system may vary without departing from the present disclosure. The corner and panel system may simplify installation and may reduce associated costs. It should be appreciated that the corner and panel system may allow immediate adaptation to variances between dimensions in drawings and actual field dimensions.

It should be appreciated that corners may have inner dimensions that may be approximately 3.25 inches by 3.25 inches. It should be appreciated that corners may have inner dimensions more or less than 3.25 inches without departing from the present disclosure. It should be appreciated that corners may have outer dimensions that may be approximately 2.5 inches by 2.5 inches. It should be appreciated that corners may have outer dimensions that may be more or less than approximately 2.5 inches without departing from the present disclosure.

It should be appreciated that corners may have inner dimensions that may be approximately 1.75 inches by 1.75 inches. It should be appreciated that corners may have inner dimensions more or less than 1.75 inches without departing from the present disclosure. It should be appreciated that corners may have outer dimensions that may be approximately 3.47 inches by 3.47 inches. It should be appreciated that corners may have outer dimensions that may be more or less than approximately 3.47 inches without departing from the present disclosure.

It should be appreciated that corners may have inner dimensions that may be approximately 3.47 inches by 3.47 inches. It should be appreciated that corners may have inner dimensions more or less than approximately 3.47 inches without departing from the present disclosure. It should be appreciated that corners may have outer dimensions that may be approximately 1.75 inches by 1.75 inches. It should be appreciated that corners may have outer dimensions that may be more or less than approximately 1.75 inches without departing from the present disclosure.

It should be appreciated that a space measuring approximately 0.85 inches may separate an outer component from an inner component of corners that may be provided to receive a panel. It should be appreciated that the space may be an opening or a throat. It should also be appreciated that a thickness of corner components may be approximately 0.06 inches without departing from the present disclosure. It should further be appreciated that the space, opening, throat, and thickness may be any dimension without departing from the present disclosure.

Figure 7A:
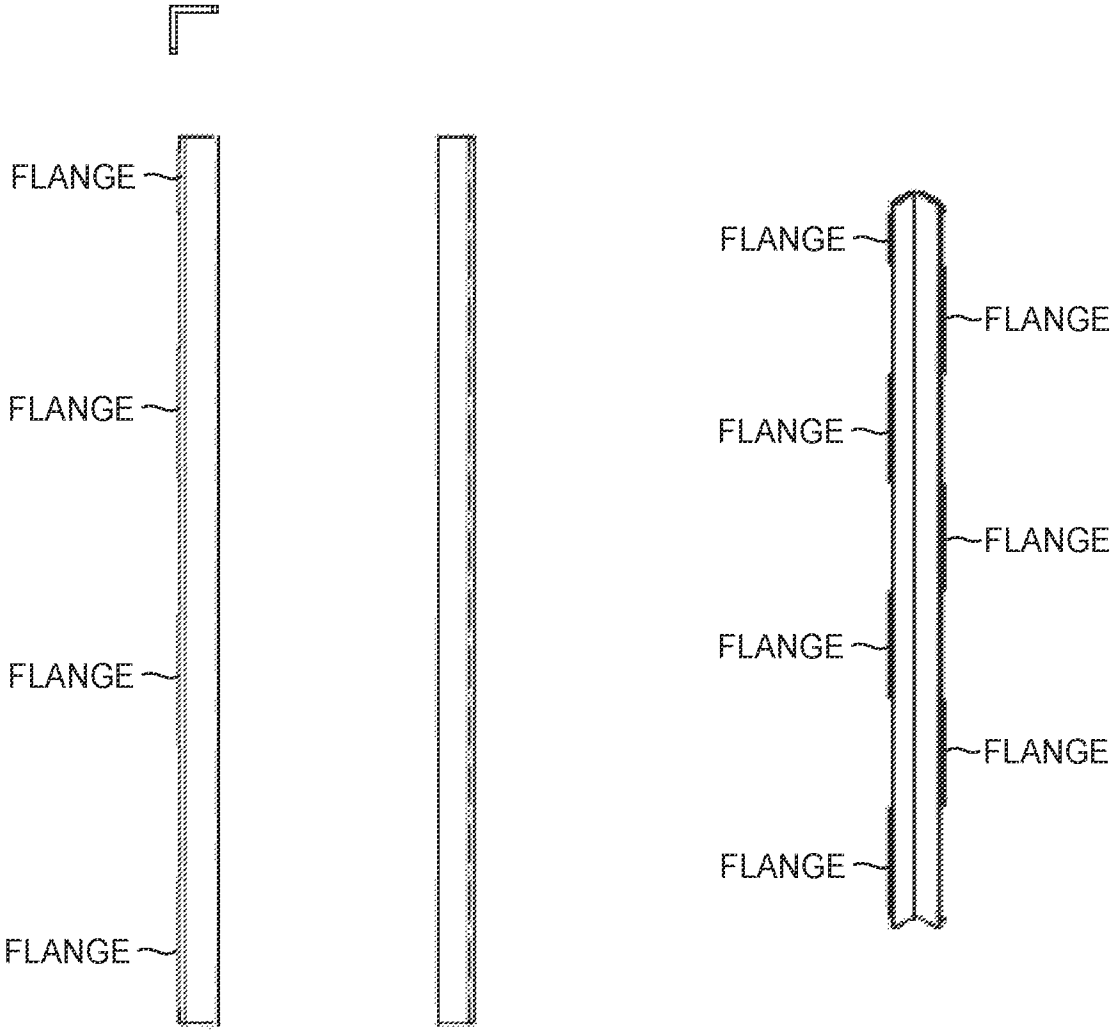
FIGS. 7A-7D depict inner and outer corner constructions according to an embodiment of the present disclosure.
Figure 7B:
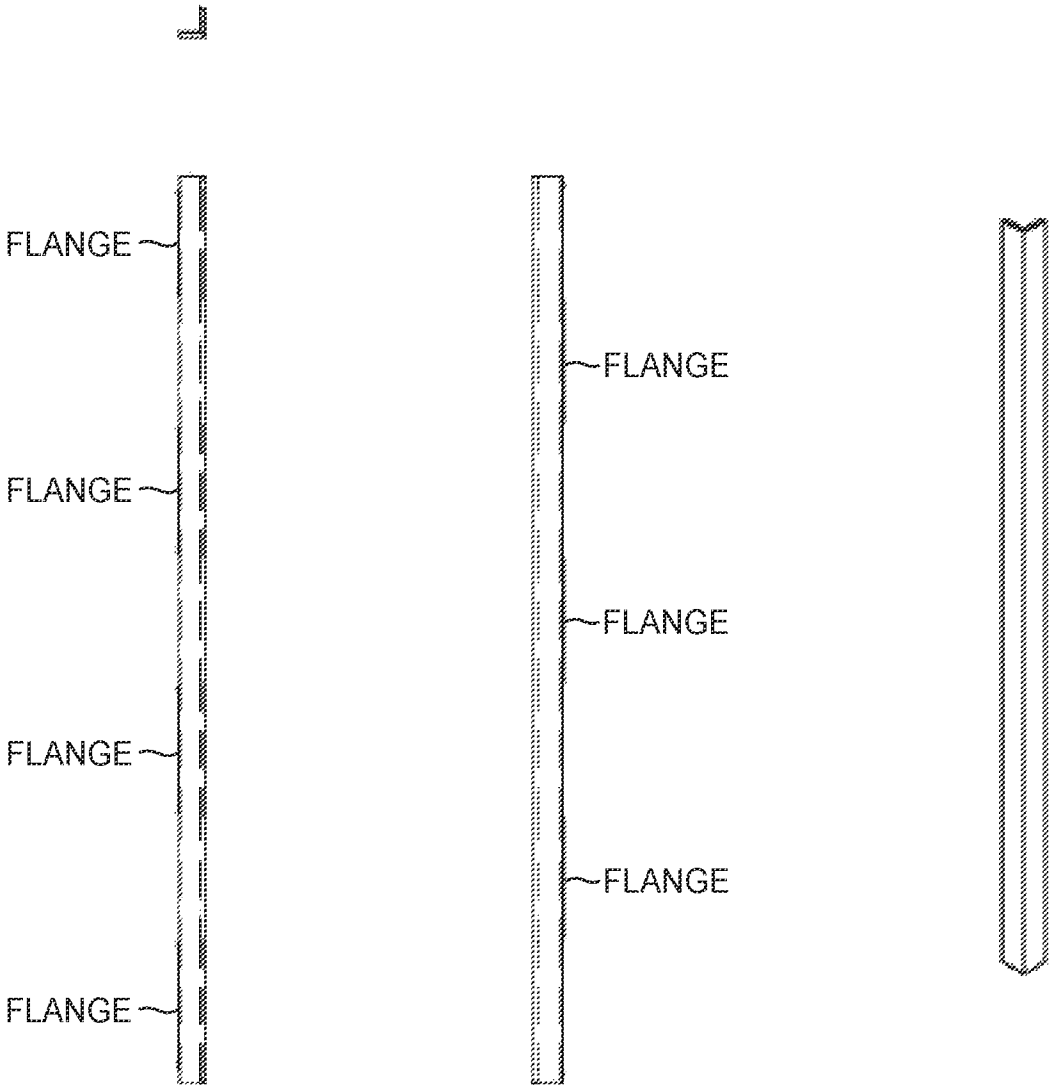
Figure 7C:
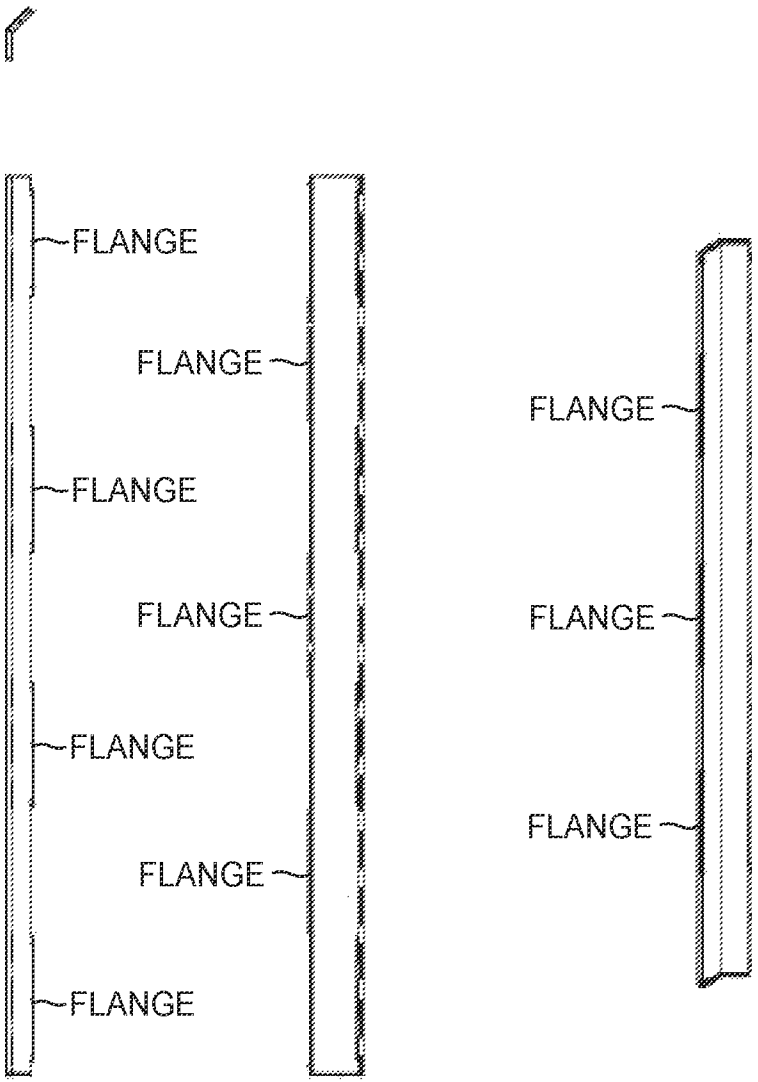
Figure 7D:
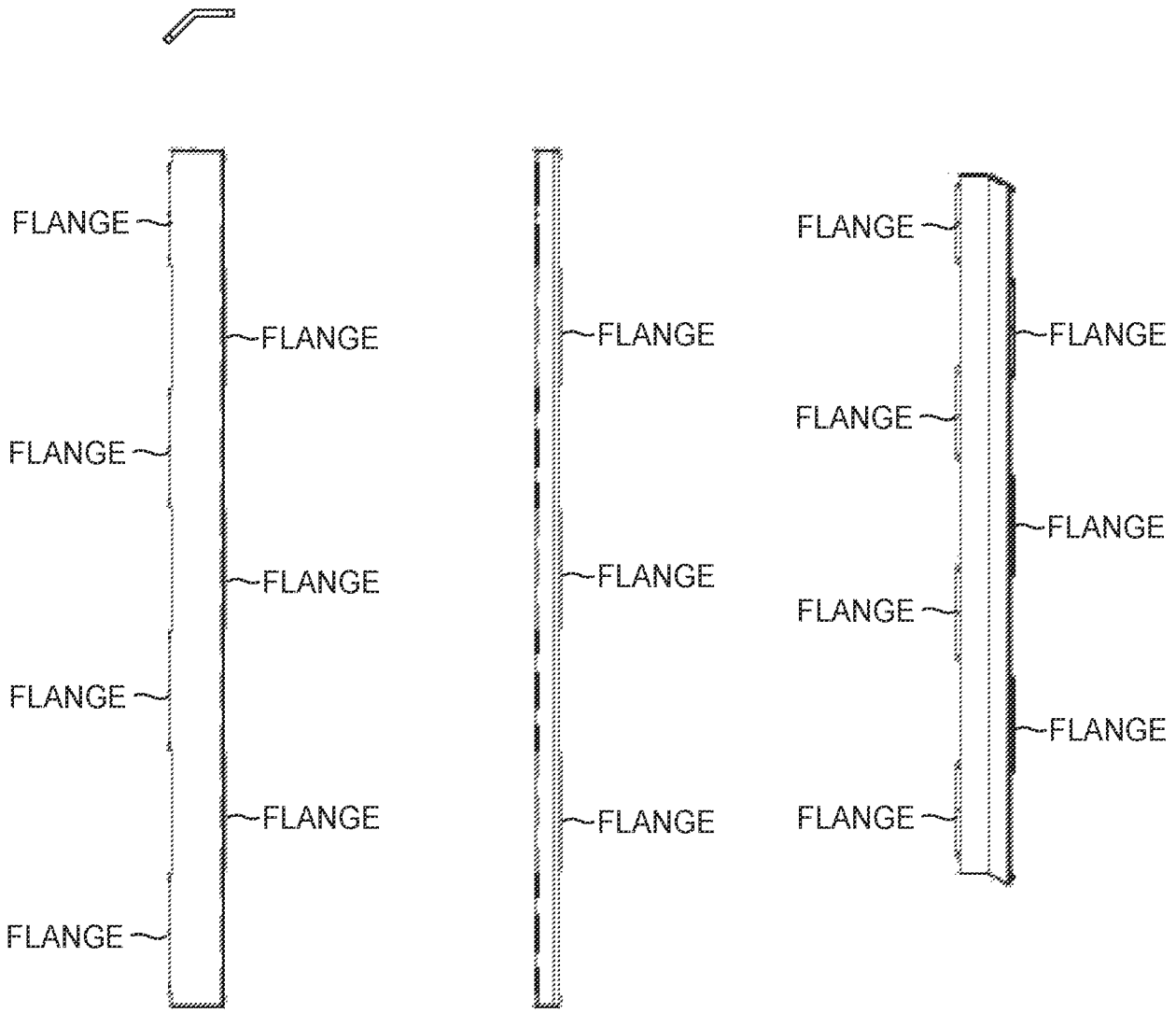

FIGS. 7A-7D depict inner and outer corner constructions according to an embodiment of the present disclosure. Each of these FIGS. 7A-7D depict a constructed view as well as an exploded view showing the components forming the corners in embodiments of the present disclosure. FIG. 7A depicts an inner corner at a 90-degree angle formed by two panels encapsulated by an inner corner. FIG. 7B depicts an outer corner at a 90-degree angle. FIG. 7C depicts an outer corner at a 135-degree angle, and FIG. 7D depicts an inner corner at a 135-angle according to an embodiment of the present disclosure.

Figure 8:
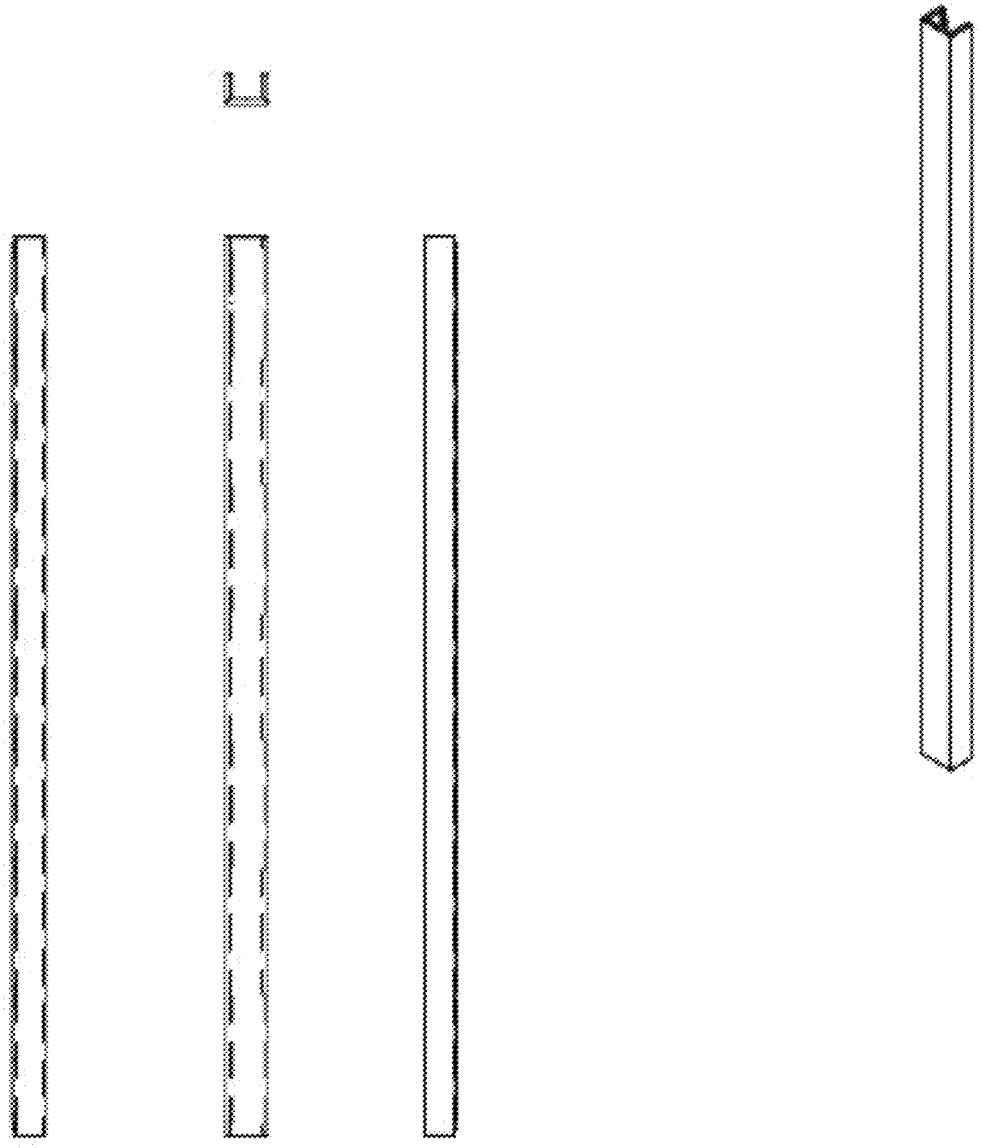
FIG. 8 depicts a U-shaped panel according to an embodiment of the present disclosure.

FIG. 8 depicts a U-shaped panel according to an embodiment of the present disclosure. As with FIGS. 7A-7D, FIG. 8 depicts a constructed view as well as an exploded view showing how three panels may be connected using a corner in an embodiment of the present disclosure. Panels may be cut down or panels may be added in embodiments of the present disclosure. This may provide the ability to grow or shrink the size of a room while maintaining the structural integrity of the wall system.

Figure 9A:
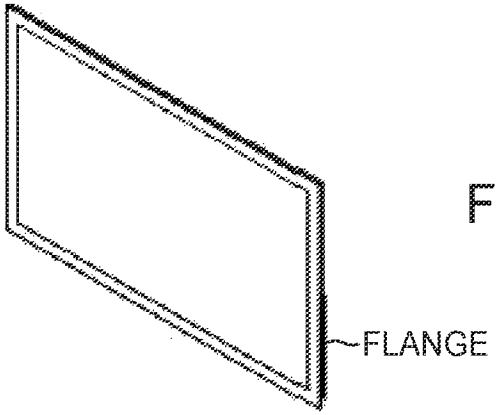
FIG. 9A depicts an edge trim according to an embodiment of the present disclosure.
Figure 9A:
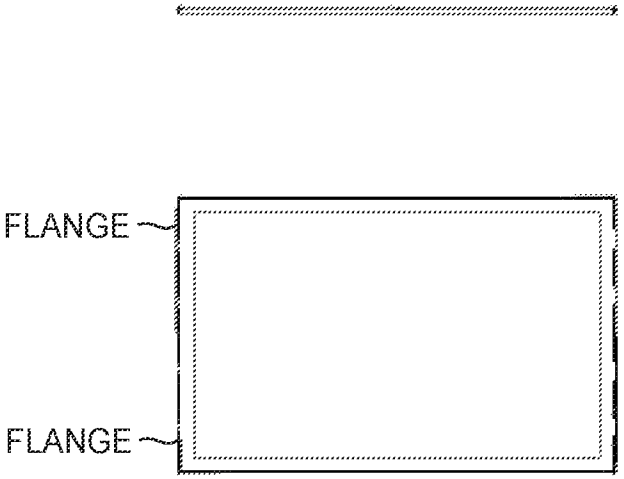
Figure 9B:
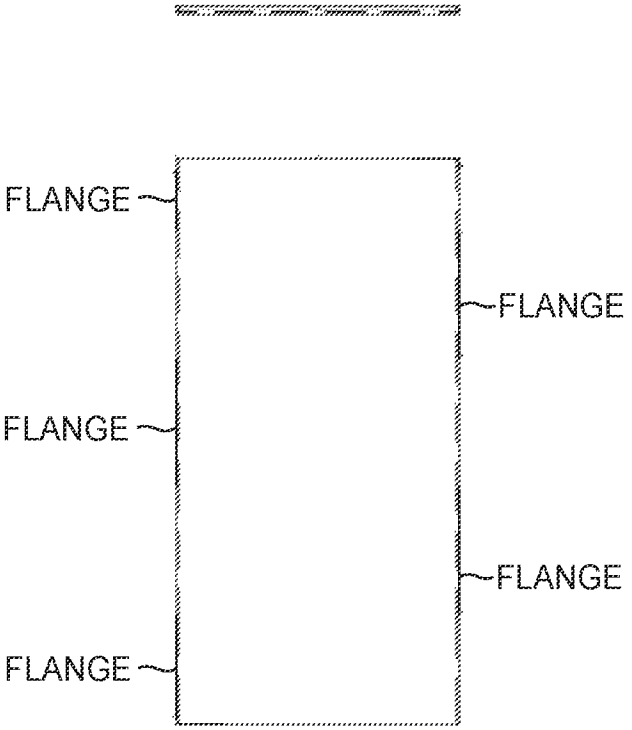
FIG. 9B depicts another view of an edge trim according to an embodiment of the present disclosure.
Figure 9C:
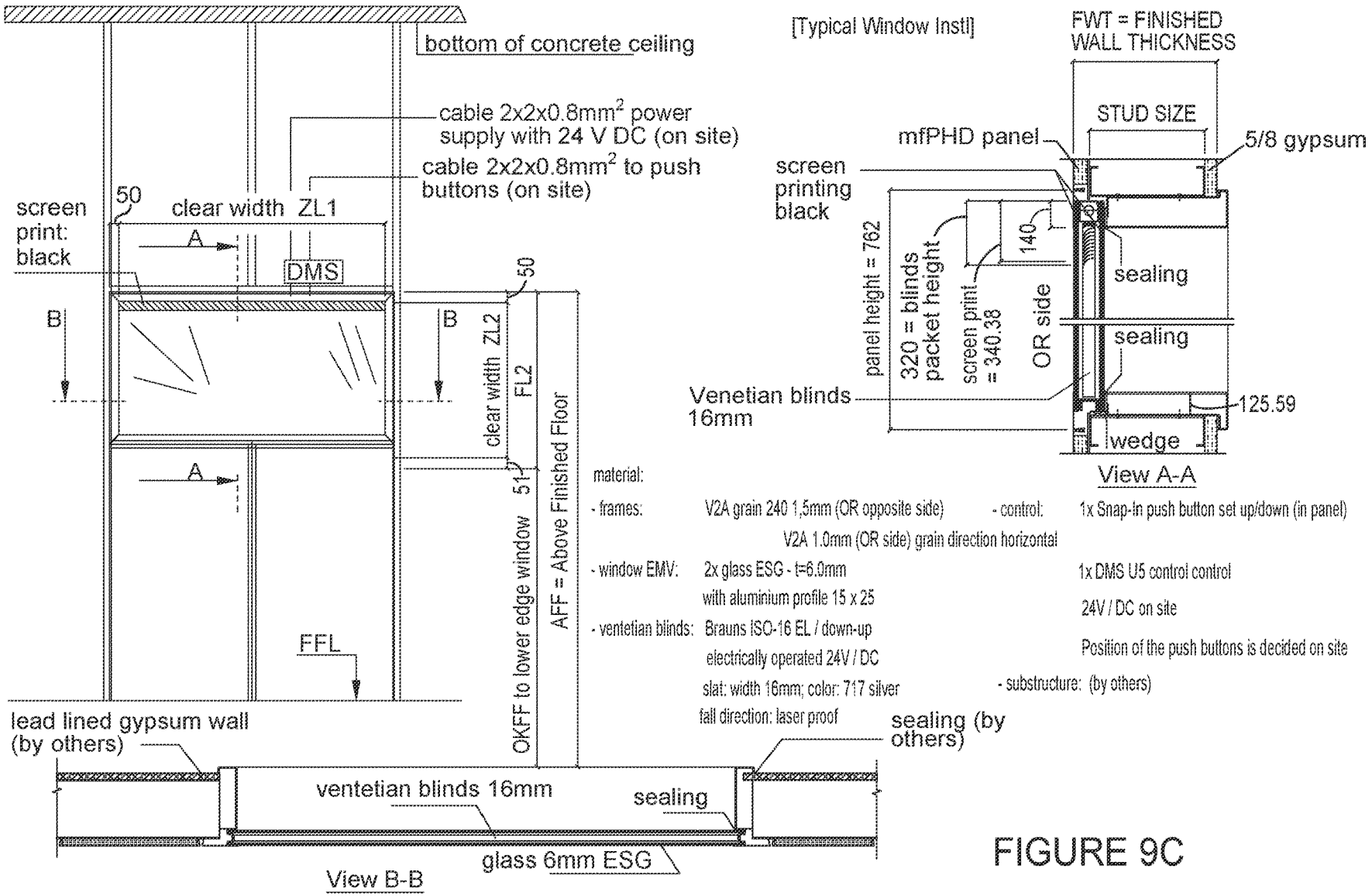
FIG. 9C depicts a window installation according to an embodiment of the present disclosure.
Figure 9D:
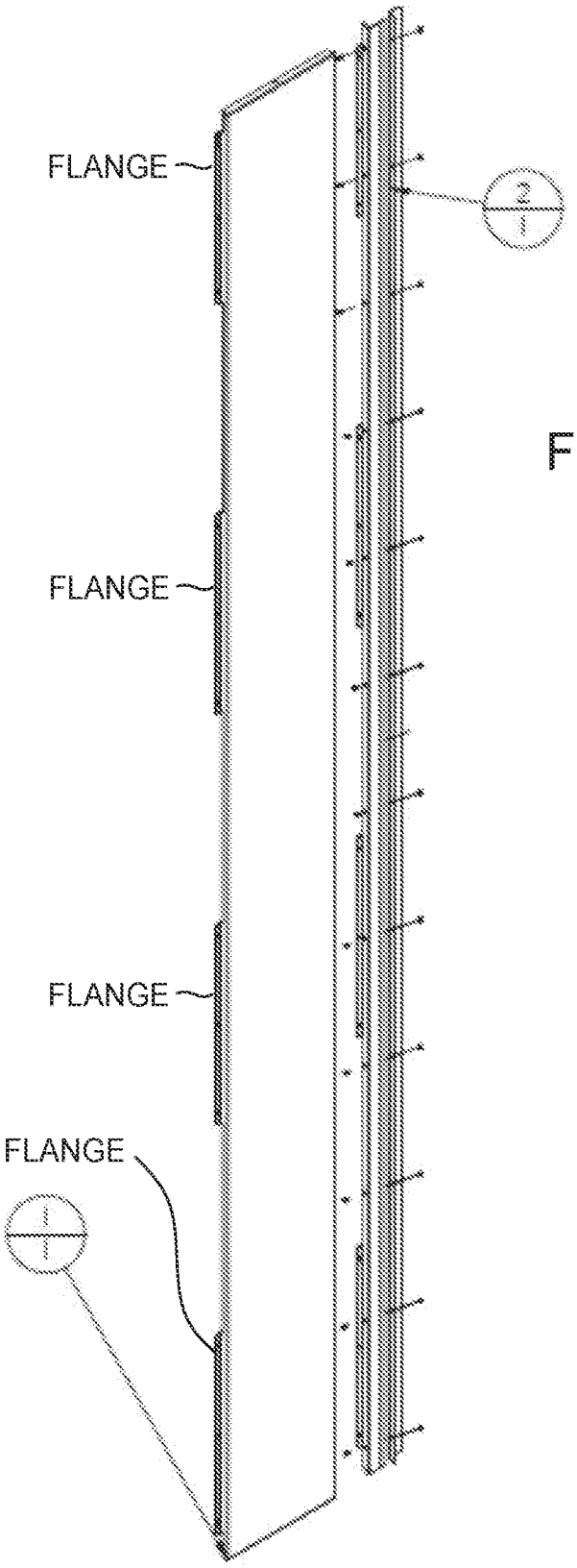
FIG. 9D depicts a trim positioned relative to a panel according to an embodiment of the present disclosure.

It should be appreciated that a wall system according to embodiments of the present disclosure may include back plates, base and ceiling profiles, and wall panels, generally made of stainless steel. However, there may be other embodiments of the present disclosure where one or more additional items may be incorporated into the wall system, including, but not limited to, monitors, white boards, and/or windows, such as a scrub-sink window (FIG. 9C). When such items are incorporated into the wall system, they may include at least one edge trim as depicted, for example, in FIGS. 9A-9B and 9D, in both constructed and exploded views.

Patients, nurses, doctors and healthcare organizations demand a clean, safe and healthy operative environment that minimizes bacteria and risk of infections. Embodiments of the present disclosure may provide a healthier environment, superior patient experience, with cutting edge prefabrication and modular design that may be more efficient to install and maintain. This may be demonstrated not only by the speed of construction and long-term maintenance benefits, but the ability to both provide a cleaner space with superior infection control that may harbor approximately 50% less bacteria than other wall systems (i.e., traditionally constructed rooms) and the ability to seamlessly and continually adapt to the ever-changing healthcare environment. More specifically, in an operating room contamination assessment, the system according to embodiments of the present disclosure had a total colony count (or heterotrophic plate count (HPC)) of 58 while the standard room had a count of 114. This assessment was done at the same facility, with the same cleaning staff, and testing the same five high-touch surfaces (walls, storage cabinet doors, documentation stations, entry doors, and monitor screens).

Systems according to embodiments of the present disclosure may provide a modular stainless-steel wall system that is hard wearing, impact-resistant, and proven to be fire resistant against temperatures of up to 1700 degrees for at least 60 minutes. Further, even after 3 years of use, and with a standard cleaning, the stainless-steel wall panels according to embodiments of the present disclosure may look brand new.

Systems according to embodiments of the present disclosure may allow wall sections or panels to be replaced after regular working hours. Traditional construction shuts the space down for several days, resulting in a decrease in service to patients and lost revenue. Replacement does not require standard ICRA containment. Panels can be cut on site, although outside the space, which may eliminate or at least significantly reduce the requirement for containment. When a section of epoxy wall needs replacement, it can take 6 days (on average) to replace it. With systems according to embodiments of the present disclosure, it can be replaced in as few as 30 minutes to 4 hours.

The wall system according to embodiments of the present disclosure may allow for rapid initial installation, which helps get an operating room up and running as quickly as possible. Repairing and replacing portions of the wall system also may result in simple, fast, and cost-effective tasks. While repairing a standard epoxy wall can take days, the system according to embodiments of the present disclosure can accomplish the same job in a period of about 30 minutes to 4 hours, which may reduce or eliminate costly downtime and delays in patient care.

Systems according to embodiments of the present disclosure may provide extra storage for supplies and tools in an easily replaceable, clean environment. Equipment may be kept in a convenient space with highly durable containment and easily cleaned surfaces. This may provide extra storage for supplies and equipment in an easily replaceable, clean environment with highly durable containment, increased infection control and durability, built for active spaces, easily cleaned, and convenience. Systems according to embodiments of the present disclosure may support windows, sinks, and device support for plug-ins. Any panel may be easily removed, providing complete access to make upgrades. Flush-mounted door systems may provide fully integrated solid core doors for increased infection control and durability. They are not only durable and easy to clean but are built to fit active spaces. The doors may be provided in both swing and slide styles.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A wall system comprising:

a plurality of drywall pieces, each drywall piece comprising a first side, a second side, and a face between the first side and the second side;

a plurality of stainless-steel panels, each stainless-steel panel adhered to the face of a respective drywall piece, and each stainless-steel panel comprising:

a first portion turned back toward the respective drywall piece to cover the first side of the respective drywall piece, and a second portion turned back toward the respective drywall piece to cover the second side of the respective drywall piece; and a plurality of backplates configured to attach the plurality of stainless-steel panels to a plurality of studs.

2. The wall system of claim 1, wherein each of the plurality of stainless-steel panels is approximately 1-2 mm in thickness.

3. The wall system of claim 1, wherein each of the plurality of stainless-steel panels is formed of 304L stainless steel, and the plurality of drywall pieces comply with ASTM C1177, ASTM C1396, ASTM C1658, and ASTM D3273.

4. The wall system of claim 1, wherein the plurality of stainless-steel panels have an antimicrobial powder coat finish.

5. The wall system of claim 1, wherein the plurality of stainless-steel panels have a flame spread of <10 and smoke developed of ≤25 for a Class A fire rating.

6. The wall system of claim 1 further comprising:

aluminum extrusions disposed at one or more corners of the wall system.

7. The wall system of claim 1 further comprising:

gaskets formed of ethylene propylene diene monomer (EPDM) (M-Class) rubber and having a watertight seal to make seams of the wall system monolithic.

8. The wall system of claim 7, wherein the gaskets are 6, 8 or 10 mm wide.

9. The wall system of claim 1, wherein the wall system includes one or more wall constructions selected from the following:

a single panel and gypsum wall; a demising wall; a 1-hour fire-rated wall; and a 1-hour double stud and gypsum wall.

10. The wall system of claim 1 further comprising:

a plurality of edge trims, each of the plurality of edge trims having a contour flange.

11. The wall system of claim 10, wherein the plurality of edge trims comprises an edge trim bottom, the contour flange having a radius of 0.040 inches and an included angle of 76.0 degrees.

12. The wall system of claim 10, wherein the plurality of edge trims comprises an edge trim left and/or right top having a contour flange with a radius of 0.040 inches in a downward direction with an included angle of 76.0 degrees, the edge trim left and/or right top further comprising:

a flange having a radius of 0.040 inches in an upward direction with an included angle of 76.0 degrees; and a bend having a radius of 0.040 inches in a downward direction with an included angle of 177.0 degrees.

13. The wall system of claim 1 further comprising:

one or more corner pieces formed of a single panel.

14. The wall system of claim 13 wherein the one or more corner pieces are formed at an angle selected from 90 degrees, 45 degrees, and/or 22.5 degrees.

15. The wall system of claim 1 further comprising:

one or more additional items selected from the following: monitors, white boards, windows, and doors.

16. The wall system of claim 1, wherein the wall system is fire resistant against temperatures of up to 1700 degrees Fahrenheit for at least 60 minutes.

17. The wall system of claim 1, wherein one or more of the plurality of stainless-steel panels is replaceable in 4 hours or less.

18. The wall system of claim 1, wherein each of the plurality of stainless-steel panels further comprises a first set of fastening flanges configured to interlock with a second set of fastening flanges of an adjacent stainless-steel panel such that each of the plurality of stainless-steel panels is separately removable.

19. The wall system of claim 1, further comprising a plurality of gaskets, each gasket of the plurality of gaskets comprising:

a head having a width that is at least 6 mm; and a plurality of legs that each have a thickness that is at least 3 mm.

20. The wall system of claim 1, further comprising:

a first set of fasteners that extend through the plurality of backplates and into the plurality of studs to attach the plurality of backplates to the plurality of studs; and a second set of fasteners that extend through the plurality of stainless-steel panels and into the plurality of backplates to attach the plurality of stainless-steel panels to the plurality of studs through the plurality of backplates.

21. A wall system comprising:

a plurality of drywall pieces, each drywall piece comprising a first side, a second side, and a face between the first side and the second side;

a plurality of stainless-steel panels, each stainless-steel panel adhered to the face of a respective drywall piece, and each stainless-steel panel comprising:

a first portion turned back toward the respective drywall piece to cover the first side of the respective drywall piece, and a second portion turned back toward the respective drywall piece to cover the second side of the respective drywall piece; and a plurality of backplates configured to attach the plurality of stainless-steel panels to a plurality of studs, each backplate of the plurality of backplates having a length that is longer than a width, and a rectangular cross-section, and each backplate of the plurality of backplates comprising:

a rectangular planar front face configured to interface with at least one of the plurality of stainless-steel panels, and a rectangular planar back face configured to interface with at least one of the plurality of studs.

22. The wall system of claim 21, wherein at least one of the first portion or the second portion is turned back toward the respective drywall piece at a first included angle that is less than 90 degrees, and is turned back away from the respective drywall piece at a second included angle to create one or more fastening flanges, wherein the second included angle is equal to the first included angle.

* * * * *